US006302272B1

(12) United States Patent
Hata et al.

(10) Patent No.: US 6,302,272 B1
(45) Date of Patent: Oct. 16, 2001

(54) PACKAGE, PACKING METHOD AND TRANSPORTING METHOD FOR BRITTLE SHEETS

(75) Inventors: Kazuo Hata; Norikazu Aikawa; Keijirou Takasaki; Masatoshi Shimomura, all of Himeji (JP)

(73) Assignee: Nippon Shokubai Co., LTD, Osaka (JP)

( * ) Notice: Subject to any disclaimer, the term of this patent is extended or adjusted under 35 U.S.C. 154(b) by 0 days.

(21) Appl. No.: 09/447,725

(22) Filed: Nov. 24, 1999

(30) Foreign Application Priority Data

Nov. 30, 1998 (JP) ..... 10-339913

(51) Int. Cl.[7] ..... B65D 85/30
(52) U.S. Cl. ..... 206/451; 206/454; 206/594
(58) Field of Search ..... 206/451, 454, 206/591, 593, 594

(56) References Cited

U.S. PATENT DOCUMENTS 3,653,501 * 4/1972 Sauer ..... 206/594
3,708,946 * 1/1973 Cahill ..... 206/593
4,892,193 * 1/1990 Thomas ..... 206/454
5,330,053 * 7/1994 Tabuchi et al. ..... 206/594

FOREIGN PATENT DOCUMENTS 8-192753 A 7/1996 (JP) .
8-310560 A 11/1996 (JP) .

* cited by examiner

*Primary Examiner*—David T. Fidei

(57) ABSTRACT

The present invention provides the first package (10) for brittle sheets, which comprises the brittle sheets (12) which are placed in a state of multiple layers and the end cushioning materials (20) (20) which are larger than the outer shape of the brittle sheets (12) and whose elasticity range from 2 to 100 mm and which are placed at both ends of the brittle sheets of lamination. The present invention also provides the second package for brittle sheets, which comprises the brittle sheets which are placed in a state of multiple layers, and the side cushioning material whose proof compressive load is not less than 1960 N in vertical direction and not less than 98 N in lateral direction and which is placed at the side of the said brittle sheets of lamination.

14 Claims, 10 Drawing Sheets

PACKAGE, PACKING METHOD AND TRANSPORTING METHOD FOR BRITTLE SHEETS

BACKGROUND OF THE INVENTION

A. TECHNICAL FIELD

This invention relates to package, packing method and transporting method for brittle sheets and, in more detail, is the art to be put to use for the transportation and storage of very thin and fragile substance subject to break, or brittle sheets, such as ceramic sheets used for the materials of the solid electrolyte membrane for fuel cell.

B. BACKGROUND ART

Ceramic sheets of 100 to 300 $\mu$m thick and 100 mm square are used for the said solid electrolyte membrane for fuel cell. The ceramic sheets is made of zirconia and so on, and are difficult to be handled because they are extremely thin and brittle as stated above.

For the purpose of transporting and storing such sheets, sheets were put in a soft bag made of synthetic resin film one by one, or in relatively small amounts, and such bags were wrapped with an air bag sheet or piled up in layers. Or sheets were placed in a state of lamination and covered with paper towels. And then these bags or the sheets in lamination were put into a case such as a paper box.

The sheets are packed separately or in small amounts in order that such brittle and fragile sheets could be free from damage during transportation or storage.

In case the said sheets are going to be transported or stored in large amounts, the process of packing or unpacking a small amount of sheets into or out of a large numbers of bags could require much time or labor. One fuel cell generating system may demand ceramics sheets in a range about 20 to 10000 sheets, or sometimes 50 to 10000 sheets. Therefore, when ceramic sheets are transported to some other place to be used in a generating system, the amount of ceramic sheets to be packed is estimated to reach 400 to 100000 sheets, or 1000 to 100000 sheets. The packing and unpacking processes are assumed to be a big trouble.

SUMMARY OF THE INVENTION

A. OBJECT OF THE INVENTION

A object of this invention is to provide such a package and packing method for thin and brittle sheets including ceramic sheets as to make the packing and unpacking processes of such sheets easier and more secure. Another object of this invention is to provide the transportation and storage method with which such thin and brittle goods as the said ceramic sheets can be fully protected from damage.

B. DISCLOSURE OF THE INVENTION

The first package of this invention comprises the brittle sheets, which are placed in a state of multiple layers, and the end cushioning materials, which are equal to or larger than the outer shape of the brittle sheets and possess an elasticity in a range from 2 to 100 mm, and which are placed at both ends of the brittle sheets of lamination. The second package of this invention comprises the brittle sheets, which are placed in a state of multiple layers, and the side cushioning material, whose proof compressive load is larger than 1960 N in vertical direction and larger than 98 N in lateral direction, and which is placed at the side of the said brittle sheets of lamination.

EXPLANATION OF NUMBERS

Figure 1:
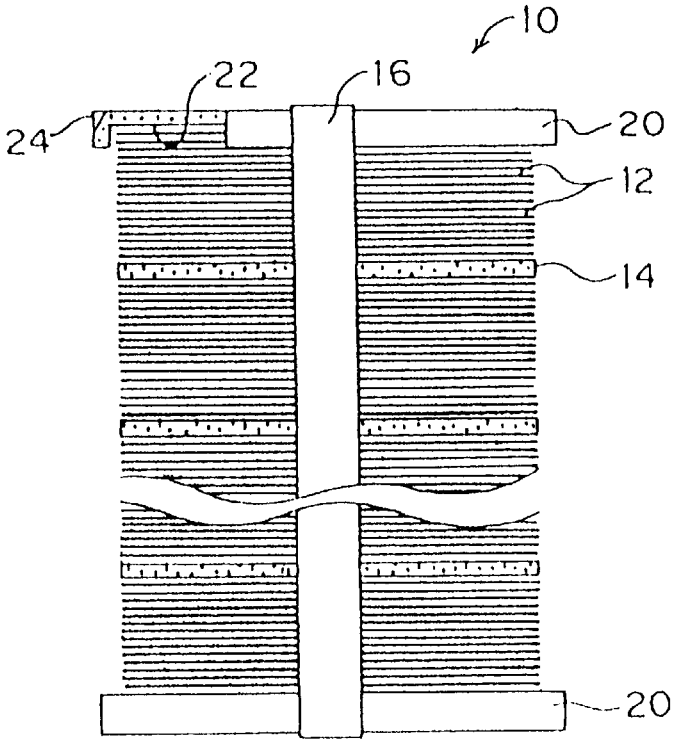
FIG. 1 is a side view of package demonstrating an embodiment according to this invention.

10 Package
11 Laminated body of brittle sheets
12 Brittle sheet
14 Intermediate cushioning material
16 Binding tape
18 Side cushioning material
20 End cushioning material
22 Hollow part
23 Open surface
24 Tape guide groove
25 Hole
28 Pad
30 packing box
40 Transportation container
44,46 Cushion holding materials
52 Small bag
54 File

DETAILED DESCRIPTION OF THE INVENTION

The specific structure is described below.

[Brittle sheet]

In case plate materials are composed of thin and brittle materials subject to crack, fracture or deformation during transportation and storage, any materials and shapes can be used for sheet materials.

In the concrete, alumina, zirconia, aluminum nitride, mullite, cordierite, alumina/borosilicate glass, cordierite/borosilicate glass, or nickel oxide/zirconia. Or oxide such as alkaline-earth metal or rare earth element is added to these ceramic materials and the resultant is used as ceramic. Or, the ceramics consisting of La perovskite type complex oxide, including $LaCrO_3$, $LaCaCrO_3$, $LaSrCrO_3$, $LaCoO_3$, $LaSrCoO_3$, $LaMnO_3$, $LaSrMnO_3$, $LaGaO_3$ or $LaSrGaMgO_3$, Ce type complex oxide including gallium, doped ceria or samaria doped ceria, or the perovskite type complex oxide in which part of the metallic element constituting these complex oxide is replaced by another metallic element is used. Furthermore, the ceramic consisting of polycarbonate resin or (meth) acrylic resin or consisting of glass is used. The laminated sheet materials that are made by means of the lamination of several such materials, or the sheet materials that are made from such materials and are coated with synthetic resin or metallic film are also used.

More specifically, the following are used: the thin film zirconia sheet stabilized with 2 mole % to 15 mole % of yttria or thin film zirconia sheet stabilized with 3 mole % to 15 mole % of scandium, which is used for the solid electrolyte membrane for fuel cell or the materials for sensor, the nickel oxide/yttria stabilized zirconia sheet or nickel oxide/samaria doped ceria sheet, which is used for the electrode sheet for fuel cell, the structure of thin film zirconia+nickel oxide/yttria stabilized zirconia, which is used for the fuel cell base plate in which electrode is laminated on the both sides or one side of the solid electrolyte membrane for fuel cell, or the structure of $LaSrMnO_3$+thin film zirconia+nickel oxide/yttria stabilized zirconia.

For the shapes of sheet materials, an adequate shape is applied for the purpose of use. In the concrete, geometrical shapes including square, rectangular shape, square with round corners, circle, ellipse and so on, or more complicated uneven shapes are applicable. Shapes having holes or notches inside a sheet material, or forming doughnut-shape such as optical disc are also applicable.

In addition, any of the following sheet materials can be used: dense body, porous body, or the structure of dense body+dense body, the structure of dense body+porous body, the structure of porous body+dense body+porous body, or the structure of porous body+porous body.

Dense body here implies the porosity of 5% or less, more desirably 2% or less, which was arithmetic with the pore volume that was measured by the Micrometritics porosimeter and with the density that was measured by a true densimeter. Porous body here implies the said porosity of more than 5% and not more than 80%.

Furthermore, the following are included: a flat plate sheet which is made when electrolyte is formed into uneven state (dimple shape), the flat plate sheet in which electrode film is formed further, or a structure in which an electrode film and a waveform holding layer are integrated into the uneven electrolyte.

For the dimension of sheet materials, it is desirable that the area of the outer surface be not less than 25 $cm^2$, the maximum outer diameter be not less than 5 cm, and the shape be rectangular of not less than 5 cm in length and width in order to be protected by the package in this invention. The said area is the area of the outer surface which is surrounded by peripheral edges and is defined as the area which includes the portion of holes or notches inside the sheet material. Especially, it is suitable to be applied to the sheet of area not less than 75 $cm^2$. As for the shape, square, rectangular shape of not less than 10 cm in length and width or circle of not less than 10 cm in diameter is preferable. Sheets of huge area, not less than 100 $cm^2$, is more adequate.

As for the thickness of sheet materials, the thinner the sheet materials are, the more we have problems in packing. The package in this invention can be applied to the sheet materials of approximately 30 to 1000 $\mu$m in thickness, and preferably of 50 to 300 $\mu$m in thickness.

As for the brittleness of sheet materials, a three-point bending fracture load ranging of 0.19 to 14.7 N is desirable to be used, and that of 0.29 to 11.7 N, 0.39 to 9.8 N, or 0.58 to 5.8 N is more desirable in order.

A three-point bending fracture load is the maximum load for a test piece to come to break in the three-point bending strength test specified in JIS R-1601. The measurement is carried out under following conditions: a test piece of 50×5 mm is used, no surface treatment such as polishing is provided on the surface, the span between the lower supporting points is 20 mm, a crosshead speed is set in 0.5 mm/minute, and then the maximum load shall be measured in the period until the test piece comes to break. Some other details of test conditions are complied with the said JIS Standards.

The three-point bending strength itself in the said JIS Standards falls within a certain range depending on the materials of the test piece; however, the three-point bending fracture load varies according to the thickness of the test piece. In this invention, therefore, a three-point bending fracture load is applied instead of a three-point bending strength because the thickness is considered to be an important condition to evaluate the brittleness of sheet materials.

Furthermore, it is desirable for the Weibull modulus of sheet materials to be not less than than 10, and that of not less than 11 or 12 is much more desirable.

For sheet materials, it is desirable that the maximum waviness height of surface is not more than 80% of the thickness of the sheet materials. That of not more than 50% or not more than 30% is more desirable, and that of 0% is the most desirable. The waviness of sheet materials implies the wave-form unevenness that was developed on the surface and the bowing of the entire sheet material, and has a bad effect on the flatness of the sheet. In case the waviness height is large, it is very difficult to pile up the sheets vertically at the time of the lamination of sheet materials. As a result, when the sheet materials are tightened in the face direction during packing and are subjected to vibration during transportation, a large amount of load is locally inflicted on the sheet materials and likely to cause crack or fracture. The measurement of the maximum waviness height is conducted by an existing measuring method and device. As a simple procedure, place a slit material on a base in a manner that the magnitude of gap can be adjusted, and skid a sheet material on the base. When the sheet becomes unable to pass under the slit material, subtract the magnitude of thickness of the sheet material from the magnitude of gap of the slit material; this difference is considered to be the maximum waviness height.

For sheet materials, it is desirable that the coefficient of static friction is not more than 3. The coefficient of not more than 2 is more desirable and that of not more than 1 is much more desirable. In case this coefficient becomes more than 3, when the sheet materials are packed and transported, the failure probability tends to increase probably because, when impact from outside is propagated to the brittle sheets in lamination, the impact is hard to be softened due to the slip of sheet materials. Such coefficient of static friction is obtained through measurement according to the test method for friction coefficient of plastic film and sheet, which is specified in JIS K7125-(1987). In this case, the following parameters are used in the measurement: a test piece of 50 mm×50 mm square felt and 2 mm thick (R36W specified in JIS L3201), a brittle sheet, as a counter material, of 100 to 300 mm or 100 to 300 mmø, a silicon rubber plate or a metal plate, as a skid piece put on the test piece, of 50 mm×50 mm square, and a load cell velocity of 100 mm/minute. The test piece and the skid piece are so set as to be pulled together with the load cell of the said velocity. The initial maximum load is assigned as the static friction force (Fs), the load of the combined pieces is set as the contact force (Fp), and the coefficient of static friction ($\mu e$) is calculated with the following equation:

$$\mu e = Fs/Fp.$$

For the surface roughness of sheet materials, in case of a dense body, the maximum height (Ry) is desirable to be 0.3 to 10 $\mu$m (standard length 2.5 mm), and more desirably 0.8 to 5 $\mu$m.

Especially in case the sheet material is a zirconia sintered body, it is desirable that the surface roughness of either side of sheet be 0.3 to 3 $\mu$m in the maximum height (Ry) and 0.02 to 0.3 $\mu$m in arithmetic mean roughness (Ra). More desirably, the surface roughness of either side of sheet material ranges 0.35 to 2 $\mu$m in the maximum height (Ry) and 0.025 to 0.1 $\mu$m in arithmetic mean roughness (Ra).

The measurement of the maximum height (Ry) and the arithmetic means roughness (Ra) can be conducted according to JIS B-0601 (1994). Concerning measurement devices, surface texture measuring instrument such as Surfcom 1400-A12 (made by Tokyo Seimitsu Co., Ltd.) is adopted.

In case such surface roughness (the maximum height (Ry), the arithmetic mean roughness (Ra)) is large in magnitude, when the sheet materials are tightened up in the face direction during packing and are subjected to vibration during transportation, a large amount of load is locally inflicted on the sheet materials and likely to cause crack or fracture. In case such surface roughness is small, the sheet materials in lamination are apt to closely adhere and become hard to be taken out. Especially, when moisture enters sheet materials because of dew formation during transportation, it is extremely difficult for a sheet material to be separated one by one, and sometime sheet materials might be damaged.

Especially in this invention, the following brittle sheets are desirable to be used: the maximum waviness height is not more than 80% of the thickness, the coefficient of static friction is not more than 3, sheet materials are made of zirconia sintered body, the surface roughness of either side of sheet materials ranges 0.3 to 3 $\mu$m in the maximum height (Ry) and 0.02 to 0.3 $\mu$m in the arithmetic mean roughness (Ra).

[Lamination of brittle sheets]

Brittle sheets are packed in a state of laminated body, where sheets, at least 2 and usually ranging of 10 to tens of thousand sheets, are placed one over another in layers. In the concrete, 100 to 30000 sheets are piled up in lamination. It is desirable that 200 to 2000 sheets or 500 to 10000 sheets be placed in lamination. The larger the quantity of sheets are, the better the efficiency of packing could be. However, the large quantity of sheets may lead to the problems that the handling of packing becomes difficult or the effect of protecting sheets decreases due to the accumulation of stress and deformation developed among the sheet materials in lamination.

The total thickness of the brittle sheets can be arithmetic in the addition of the product of a thickness per brittle sheet and the number of the laminated layers and the thickness of the member constituting the laminated body other than the brittle sheets, such as end cushioning materials. Usually, the thickness of the laminated body is set to be 10 to 1500 mm, and preferably 20 to 1000 mm or 50 to 800 mm.

Especially, the laminated body of brittle sheets is desired to be packed with such packing materials as bags for the purpose of increasing the efficiency of packing and unpacking processes or protecting brittle sheets from contamination (adhesion of dust/dirt or dew formation/water leakage among sheets). Bag-like packing materials have no special limitation as long as they satisfy the said purposes, and include polyethylene bags and anti-electrostatic polyethylene bags.

[End cushioning materials of the first package in this invention]

In the first package of this invention, normal cushioning materials are applied in principle, if they can be attached to the both sides of the brittle sheets in lamination and protect the sheet materials from shock.

The size of the end cushioning materials is the same as or a little larger than the outer shape of the brittle sheets. Usually, the end cushioning materials having the similar shape to that of the sheet material is selected; however, if the end cushioning materials holds a shape possible to cover the outer shape of the sheet, for instance the application of end cushioning materials of rectangular shape to round sheet, it is no problem.

The difference between the outer dimension of sheet material and the inner dimension of end cushioning materials is proposed to be 0 to 20 mm in entire periphery, and more desirably 0 to 10 mm.

Flat and plate type end cushioning materials can be used, and if necessary, end cushioning materials of sponge structure or that with notches or holes is applicable.

It is possible to form hollow part on the contact surface of end cushioning materials with sheet material. Due to this hollow part, the laminated sheet body and the end cushioning materials can be positioned without slip. It is desirable that the inner shape of the hollow part be made a little larger than the outer shape of sheet material. The depth of the hollow is proposed to be about 2 to 10 mm. Instead of hollow part, the surface of end cushioning materials correspondingly in contact with the periphery of sheet material can be furnished with protruding part for positioning, such as projection or protruding bar.

In case the binding materials below described is applied, guide groove can be built at the peripheral edge on end cushioning materials to guide binding materials. Instead of guide groove, end cushioning materials can be equipped with protruding part such as protruding bar for positioning binding materials.

As for materials for end cushioning materials, usual packing materials or cushioning materials are used, such as polyurethane, polyethylene, neoprene rubber, butyl rubber, paper and wood. These materials are used in forms of foaming body or sponge structure, sheet form, plate form, felt structure, corrugated paper (corrugated fiberboard) and plywood. These materials can be laminated and used in a form of laminated layers. In case the surface of end cushioning material correspondingly contacting with brittle sheet is made of the above-mentioned materials superior in cushioning, the rest of the surface or the part could be constituted with materials less cushioning.

For end cushioning material, it is proposed that elasticity be 2 to 100 mm. This elasticity was measured in accordance with the elasticity test specified in JIS K-5400 (1979). The test procedures are as follows: attach the end cushioning material along a guide of a given diameter (1 mm pitch), bent them up to 90°, remove the guide and then visually observe the state of damage. An elasticity of 100 mm, for instance, implies that when the test is conducted with a guide of 99 mm in diameter, the end cushioning material has at least one selected from break,fracture and crack and does not recover even when the guide is remove, and however, when the test is carried out with a guide of 100 mm in diameter, neither break, fracture nor crack occurs on the end cushioning material. In case elasticity is too small, such as not more than 1 mm, it is impossible to demonstrate the function of cushioning since the material is less elastic and subject to deformation. On the other hand, in case elasticity is too large, it is also inferior in the function of cushioning, since the material is so firm that the outer force is propagated directly to brittle sheets. Desirable conditions in elasticity are to be 3 to 100 mm, 5 to 50 mm or more desirably 10 to 30 mm.

The thickness of end cushioning material is so set as to satisfy the above conditions of elasticity: in the concrete, 2 to 100 mm, or more desirably 3 to 60 mm or 5 to 30 mm. In case there is hollow part or any other unevenness above mentioned on end cushioning material, the thickness is determined in corresponding to the thickness between the contact surface with brittle sheet and the outer surface. When packages are composed, it is recommended to apply a certain pressure between the end cushioning material and the brittle sheets in the surface direction. The preferable range of surface pressure is 98 to 49000 Pa, more desirably 980 to 29400 Pa, and even more desirably 1960 to 19600 Pa. Excessively large surface pressure could cause such problems as breakage or deformation of brittle sheets due to surface pressure. For the purpose of applying an adequate pressure to brittle sheets, the use of binding material described below is effective on the laminated end cushioning materials and brittle sheets. Furthermore, surface pressure can be developed when end cushioning materials and brittle materials are packed into a rather small container box.

[Intermediate cushioning materials of the first package in this invention]

To the first package of this invention, intermediate cushioning materials can be placed between the laminated layers of brittle sheets at a certain interval.

The materials and the shapes of the intermediate cushioning materials are generally the same as those of end cushioning materials previously described. Different from end cushioning materials, intermediate cushioning materials are not subject to outer force directly; therefore, relatively soft materials or less deformation-resistant materials can be used. The thickness of the intermediate cushioning material is set to approximately 0.01 to 20 mm, and more desirably 0.05 to 10 mm. In case of intermediate cushioning material, a rather smaller size than that of end cushioning materials makes the packing process easier, such as binding with below-described binding materials and packing into container boxes.

In case numbers of brittle sheets are laminated alone, stress and strain are developed and accumulated among brittle sheets and could cause damage or deformation in them. Therefore, it is recommended to place intermediate cushioning materials at such intervals as to control the stress and strain. Specifically, an intermediate cushioning material can be placed every tens to hundreds of sheet materials. It is also possible to put an intermediate cushioning material per every sheet.

[Binding material of the first package in this invention]

In the first package of this invention, binding materials are used to unite the laminated body comprising brittle sheets and end cushioning materials.

Binding materials include ropes, tapes or bands made of synthetic resin, rubber, paper or fibers. It is preferable that binding materials are made of such a soft material as to make binding and unbinding processes easier. In case tape type binding materials are equipped with adhesive layer or glue layer on the back surface, the ends of the binding materials can be overlapped and fixed adhesively. Binding materials equipped with detachable fitting can be used repeatedly.

With binding materials, constant pressure may be put on the surface of brittle materials from end cushioning materials. Such surface pressure may prevent displacement of sheet materials, bump of sheet materials each other or development of distorted stress on sheet materials.

[Packing box and container bag of the first package in this invention]

In the first package of this invention, the said package can be transported and stored as it is; however, to put the package into a packing box or a container bag protect brittle sheets from dust or foreign substance. It is also expected that such a box or a bag has cushioning effect on outer force.

Packing boxes employ similar materials and formation to those of other packing boxes usually used for various goods. For instance, paper such as corrugated fiberboard, synthetic resin such as polyurethane and its foam, wood such as plywood, metal such as duralumin, and other materials are included as well as the materials coated with synthetic resin on inner or outer surface of these materials.

It is desirable that a packing box have such a shape or a dimension as to contain the said package in an immovable state, and is so constructed that one side or several sides can be flexibly opened. A packing box can be built around the package by folding out sheet materials.

End cushioning materials are previously fitted at corresponding locations inside the packing box and then brittle sheets are placed between the end cushioning materials, so that package is constructed in unity with the packing box.

For container bags, common packing bags that are made of synthetic resin or paper are used. With them, package can be free from dust or foreign substance. After brittle sheets and end cushioning materials are put into a container bag, the outside of the container bag is bound with a binding material, so that package is constructed in unity with the container bag. A packing box can contain the container bag where brittle sheets and end cushioning materials are housed.

Packing boxes or container bags may be put into other transportation container or storage container. In this case, to secure the cushioning against shock, it is recommended that ordinary cushioning for packaging be placed between the packing box and the transporting container. For transportation container, containers for ordinary package transportation are used, including corrugated fiberboard boxes, wood boxes, metallic containers.

[Other packing materials of the first package in this invention]

In the first package of this invention, brittle sheets are placed into a file or a small bag, and these files or bags are laminated each other and then constitute package.

A file consists of the several filing pads whose one end is filed. The filing pads are made of flexible synthetic resin film or paper, and are a little larger than the outer shape of brittle sheets. Thin pads of a thickness of approximately 0.01 to 2 mm are desirable. Being put into filing pads, each brittle sheet may be protected in a good condition. In addition, in comparison to individual bags, packing and unpacking processes of brittle sheets can be implemented easily.

Brittle sheets may be divided in a relatively small amount and put into a small bag. Such small bags are piled up in lamination and then this laminated body comes to construct a package. Similar materials to those of the said filing pads are used for small bags. The use of such small bags allows brittle sheets to be easily handled in an appropriate amount.

[Side cushioning materials of the second package in this invention]

In the second package of this invention, side cushioning materials are placed on the said laminated brittle sheets.

As for the strength of side cushioning materials, a proof compressive load is not less than 1960 N in vertical direction, desirably not less than 4900 N, and more desirably not less than 9800 N. In lateral direction, it is not less than 98 N, desirably not less than 196 N, and more desirably not less than 294 N.

The proof compressive loads of side cushioning materials in vertical direction and in lateral direction comply with the compressive strength test of JIS Z-0401. After cushioning materials were dried sufficiently at 50° C., measurement was carried out at crosshead speed of 2 mm/minute with the AUTOGRAPH DSS-25T made by Shimadzu Corporation, and then the maximum load was read and set to be a proof compressive load.

When proof compressive loads of side cushioning materials in vertical direction and in lateral direction fall within the above ranges, the following benefits can be obtained:

① to improve transportation efficiency by multiple piles

② to reduce the product damages caused by shocks during transportation

③ To improve the work efficiency in the packing and unpacking of products

④ to reduce packing cost.

Inner dimensions of side cushioning material need to be a little larger than the outer dimensions of brittle sheets because brittle sheets need to be put in and out. The size is recommended to be 0.3 mm larger than a side or diameter of brittle sheet, or preferably 1 mm larger. The clearance should be not more than 10 mm for the purpose of protecting brittle sheets, and preferably not more than 5 mm.

The outer dimensions of side cushioning material relate to a proof compressive load corresponding to the thickness of the side cushioning material. To achieve the said proof compressive loads, it is desirable that the thickness of the cushioning material be 3 mm to 20 mm, more desirably 5 to 15 mm. The height of side cushioning material is necessary to be equal to or larger than that of the laminated body of brittle sheets. Depending on the height of the laminated body, the height of side cushioning material is generally set to be 10 mm to 300 mm, and considering the work efficiency for brittle sheets of putting in and out, the range from 20 mm to 200 mm is desirable and 30 mm to 100 mm is more desirable.

The shape of side cushioning materials is not specially limited; however, for the purpose of protecting brittle sheets, it is recommended to be similar to that of brittle sheets. In general, cylindrical or square pillar shape is used. One of the horizontal surfaces of the side cushioning material could be sealed. The glass type or square type in which one of such horizontal surfaces is partially or completely sealed is also used.

For the materials for side cushioning materials, paper materials, such polymer materials as polyethylene, polypropylene or poly vinyl chloride, or wood materials are selected; however, it is recommended to use paper materials considering recyclability, lightness, and easiness in treatment as waste. In case rolled paper is used, spiral type is appropriate considering strength and smoothness when the laminated body of brittle sheets is putting in and out.

[End cushioning materials of the second package in this invention]

In the second package of this invention, end cushioning material can be placed at either side of the laminated body of brittle sheets to prevent the laminated body of brittle sheets from coming out of a tube of end cushioning material.

The size of end cushioning materials is same as or a little larger than that of the outer shape of brittle sheets. They may be used in a manner that they are inlaid in the side cushioning materials or cover the side cushioning materials containing the laminated body of brittle sheets. Or, when packages of this invention are put into the packing box below stated, end cushioning materials of large area may be used, so that several packages are protected in unity.

When the size of end cushioning materials is the same as or a little larger than that of the outer shape of brittle sheets, end cushioning materials holding a similar shape to the outer shape of sheets are selected; however, if the end cushioning materials holds a shape possible to cover the outer shape of the sheets, for instance the application of end cushioning materials of rectangular shape to round sheet, it is no problem.

Concerning the shape of end cushioning materials, the shape is the same as the end cushioning materials on the first package of this invention. In addition, as the same as the first package of this invention, hollow part or protruding part may be formed.

Concerning the materials, elasticity and thickness of end cushioning materials, they are the same as the end cushioning materials on the first package in this invention.

Concerning the surface pressure between the end cushioning materials and brittle sheet when a package is constituted, the pressure is the same as the end cushioning materials on the first package in this invention.

[Intermediate cushioning materials of the second package in this invention]

In the second package of this invention, as the same as the first package of this invention, intermediate cushioning materials may be placed.

Concerning the materials/shapes/numbers of the laminated layers of intermediate cushioning materials, they are the same as the intermediate cushioning materials on the first package of this invention, and when there exist a cushioning effect between the laminated layers of brittle sheets, any shape may be adopted; however, in the second package of this invention, the same shapes as that of brittle sheets are desirable.

[Packing box and container bag of the second package in this invention]

In the second package of this invention, as the same as the first package of this invention, packages may be put into packing boxes or container bags.

[Other packing materials on the second package of this invention]

In the second package of this invention, as the same as the first package of this invention, brittle sheets may be placed into a file or a small bag, and these files or bags are laminated each other and then constitute a package.

[Transporting method]

In this invention, brittle sheets are transported in a state of the laminated body of brittle sheets. The said brittle sheets comprise brittle sheets or zirconia sintered body whose maximum height of waviness is less than or equal to 80% of their thickness and the coefficient of static friction is less than 3. The surface roughness of either sheet surface ranging from 0.3 to 3 μm in maximum height(Ry) and from 0.02 to 0.3 μm in the arithmetic mean roughness (Ra) may be applicable.

In order to transport brittle sheets in a state of the laminated body of brittle sheets, the first and the second package in this invention the above mentioned may be used without limitation.

[Embodiment of the invention]

FIGS. 1 to 10 show the first package of this invention.

FIG. 1 shows the package constituting the embodiment of the first package of this invention.

The package (10) contains the brittle sheets (12) of plane rectangular shape. The brittle sheets (12), usually consisting of 10 to 10000 brittle sheets, are placed by being overlapped face to face.

Among the lamination layers of the brittle sheets (12), intermediate cushioning materials (14) are placed at regular intervals. The intermediate cushioning materials (14) are made of synthetic resin sheets and posses the same as or a little smaller than the brittle sheets (12).

Figure 2:
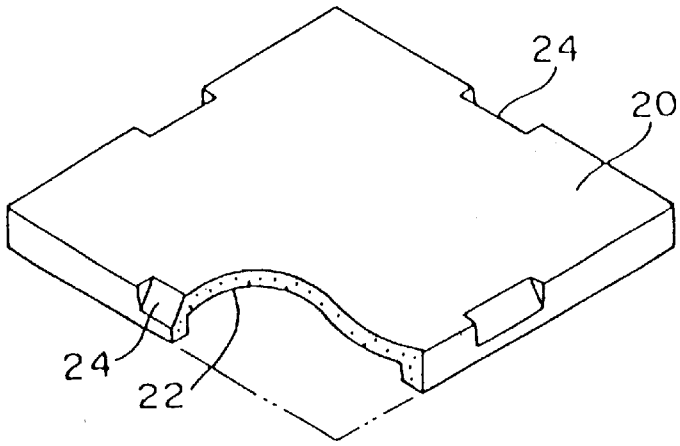
FIG. 2 is a perspective view of end cushioning material.

At both ends of the lamination layers of the brittle sheets (12), end cushioning materials (20) (20) are placed. As shown in FIG. 2 in more detail, the end cushioning material (20) is composed of the synthetic resin foam. Its plane constitutes a nearly rectangular shape larger than that of the brittle sheets (12), and the inner face in contact with the brittle sheet (12) holds the hollow part (22) whose size is almost same as that of the brittle sheet (12). In the middle of each side on the peripheral edge of the end cushioning material (20), the corner of the edge is cut, and each cut serves as tape guide groove (24).

As shown in FIG. 1, the pillar-like laminated body comprising the brittle sheets (12) and the intermediate cushioning materials (14) that are placed between them at regular intervals is constructed in a manner that the body is interposed between the end cushioning materials (20) placed in the both ends.

At the outside of the end cushioning materials (20) (20), the binding tape made of synthetic resin (16) is so bound as to be fit into the tape guide groove (24) and then fastens up and fixes the end cushioning materials (20)(20), brittle sheets (12) between them and the intermediate cushioning materials (14). The presence of the tape guide groove (24) secures the positioning of the binding tape (16) and prevents the tightening force toward the brittle sheets (12) from locally being biased. With the tightening force of the binding tape (16), the surface pressure applied on the brittle sheets (12) can be controlled.

The package (10) of rectangular pillar that is constructed in the above manner can be transported or stored as it is. The package (10) may also be placed into another packing bags or packing containers for handling.

Figure 3:
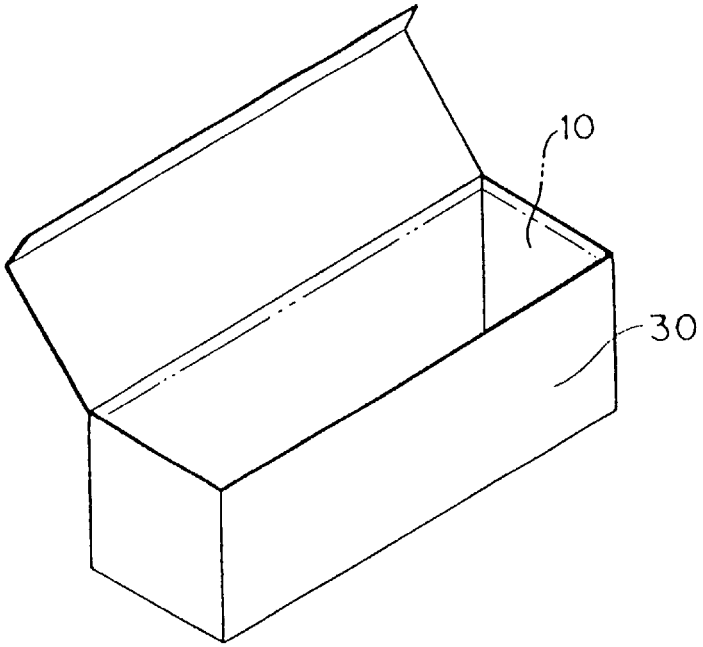
FIG. 3 is a perspective view of packing box.

In the packing box(30) shown in FIG. 3, the package (10) can be laid on its side. The packing box (30) is made of plastic such as polypropylene, metal such as duralumin, or corrugated fiberboard, and comprises a bottom face, four side faces, and an upper face that is attached to a top end of one of the sides and that can be opened and closed flexibly. When the package (10) is placed into the packing box (30), the brittle sheets (12) inside the package (10) are free from dust or foreign substance. In addition, the brittle sheets (12) are protected against outer force. Packing boxes are not limited to that shown in FIG. 3, in which the package (10) is laid on its side; the package (10) may be laid end to end in other type of packing box.

Figure 4:
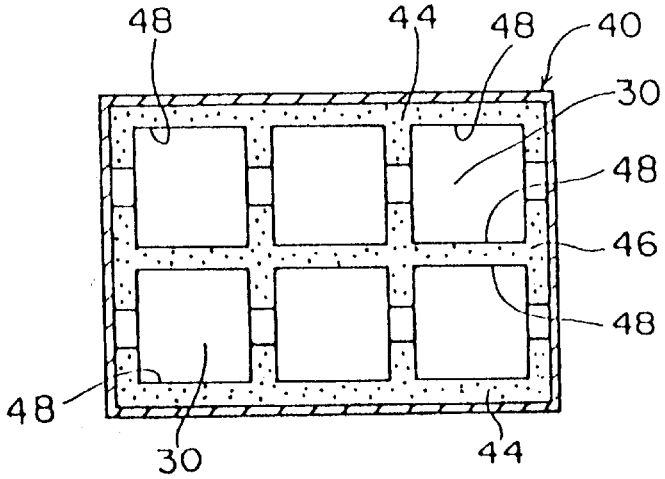
FIG. 4 is a sectional view of transportation container.

The transportation container (40) shown in FIG. 4 comprises several packing boxes (30). Inside the transportation container (40), the tray type cushion holding materials (44) (46) are placed to hold the packing boxes (30). The cushion holding materials (44) (46) are made of the synthetic resin foam, formed into such a shape of thick plate as to be placed into the transportation container (40), and equipped with holding hollow parts (48) on its one face or both faces, in which the packing box (30) is fitted.

In the packing configuration shown in the figure, the cushion holding materials (44) (46) are placed on the top, the bottom and the middle of the packing boxes (30) that are arranged in two rows and three columns. The top and the bottom of the cushion holding materials (44)(44), which are equipped with the holding parts (48) on the lower face and upper face, respectively, are so placed that the packing boxes (30) are fitted into the respective holding hollow parts (48), and the middle of the cushion holding material (46), which is equipped with the holding parts (48) in either face, is so placed that the packing boxes (30) are fitted into the holding parts (48).

As a result, each packing box (30) is to be laid in the transportation container (40) with an adequate distance from each other in every direction, and in a good condition under the holding by the cushion holding materials (44)(46).

[Direct packing into packing boxes]

Figure 5:
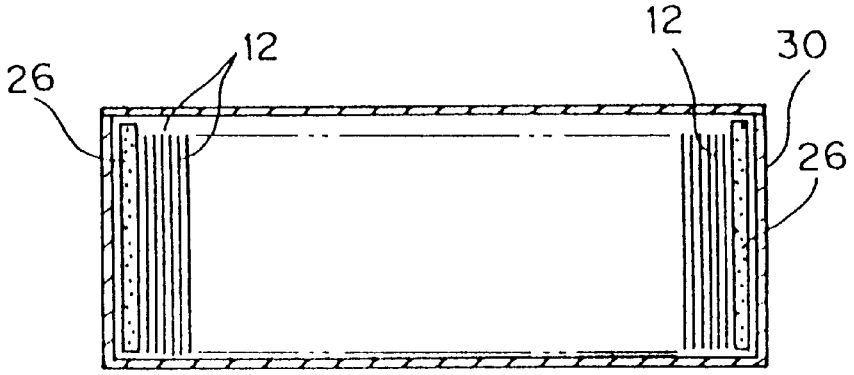
FIG. 5 is a sectional view of packing box demonstrating another embodiment according to this invention.

In the embodiment shown in FIG. 5, numbers of the brittle sheets (12) are directly placed into the packing box (30) similar to the previous one, without the use of the binding tape above described, and thus constitutes a package.

Numbers of the brittle sheets (12) are placed into the packing box (30) in a manner that the both ends of the brittle sheets (12) adequately comes in contact with the end cushioning plates (26) (26) of rectangular shape. The inner length of the packing box (30) is designed to be a little shorter than the combined length of the brittle sheets (12) and the end cushioning plates (26) (26), and the packing box (30) may be elastically deformed in order to contain the brittle sheets (12) and the end cushioning plates (26) (26); consequently, in a state of packaging in the packing box (30), a constant surface pressure is applied on the brittle sheets (12).

Figure 6:
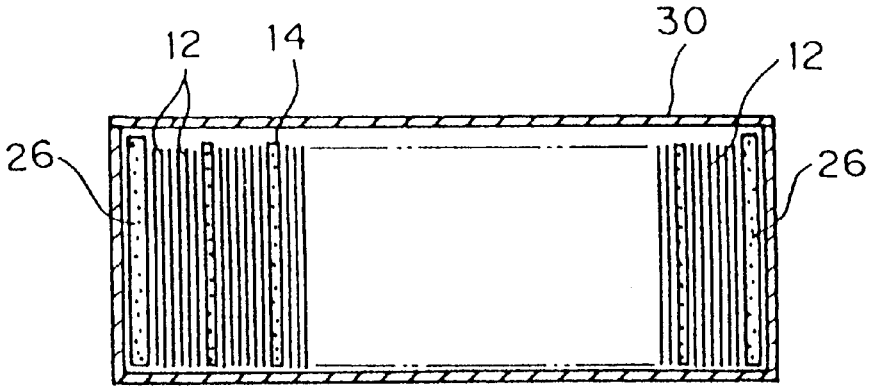
FIG. 6 is a sectional view of packing box demonstrating another embodiment according to this invention.

As shown in FIG. 6, it is possible to place the said intermediate cushioning materials (14) at regular intervals in the middle of the laminated rows of the brittle sheets (12).

[Use of small bags]

Figure 7:
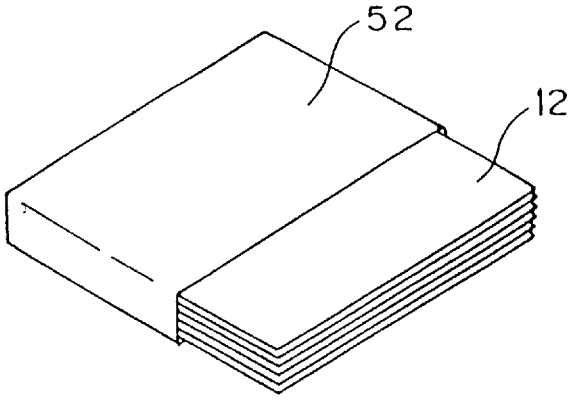
FIG. 7 is a perspective view of container bag demonstrating another embodiment according to this invention.
Figure 8:
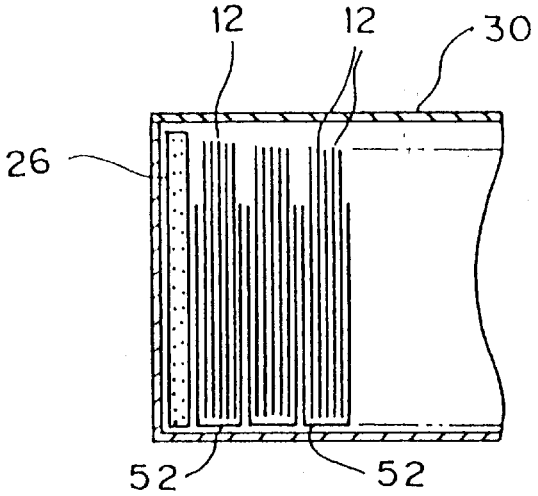
FIG. 8 is a part of sectional view of packing box containing small bags.

In the embodiment shown in FIGS. 7 and 8, the brittle sheets (12) is placed into a small bag (52).

As shown in FIG. 7 in detail, the small bag (52) may constitute such a rectangular shape as to be a little wider in width and a little narrower in depth corresponding to each length of the brittle sheets (12), and holds such a thickness as to contain several sheets to hundreds sheets of the brittle sheets (12). In FIG. 7, in the packed state of the brittle sheets (12) that are put into the small bag (52), part of the brittle sheets (12) comes outside of the small bag (52).

As shown in FIG. 8, the small bags (52) containing the brittle sheets (12) may be placed side by side inside the packing box (30), and the end cushioning plate (26) may be put at the both ends of the row of the small bags (52). In the above embodiment, a bunch of brittle sheets (12) may be handled by means of the small bags (52), so that the packing process into the packing box (30) or unpacking process becomes easy to be carried out. In comparison with the packing process in which the brittle sheet (12) is placed into the packing box (30) one by one, the use of the small bags (52) can save time.

[Use of files]

Figure 9:
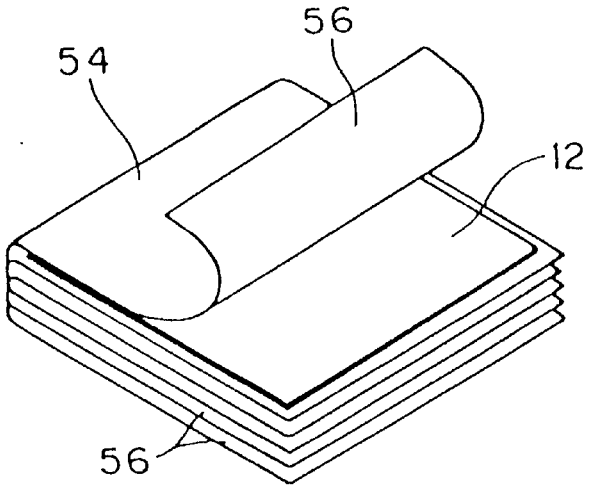
FIG. 9 is a perspective view of file demonstrating another embodiment according to this invention.
Figure 10:
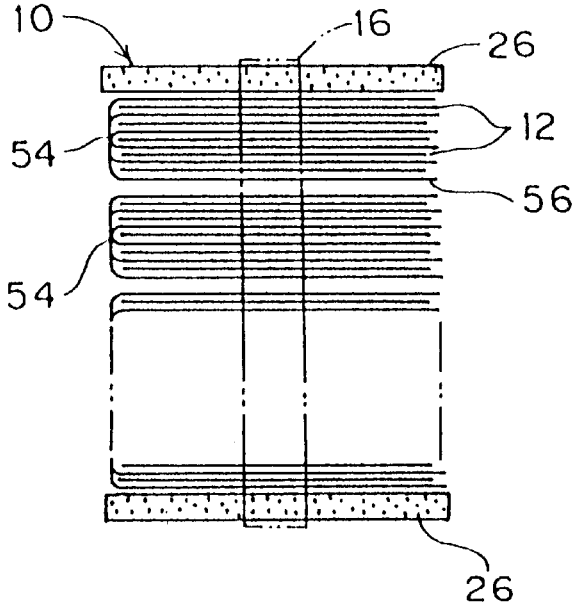
FIG. 10 is a side view of package by the use of files.

In the embodiment shown in FIGS. 9 and 10, a file (54) is used.

The file (54) is made of relatively flexible synthetic resin film and comprises several filing pads (56), whose outer shapes are a little larger than that of the brittle sheets (12). They are filed unitedly at the end of the one side.

The brittle sheets (12) are inserted between the filing pads (56) of the file (54) one by one. Coming in contact with the filing pads (56), each brittle sheet (12) is thus protected.

In FIG. 10, the files (54) containing the brittle sheets (12) are piled face to face, and the end cushioning plates (26) (26) are placed on the top and the bottom of the piled body. With the binding tape (16), the piled body is fastened to be fixed unitedly; thus the package (10) is constructed.

In the above embodiment, with the filing pads (56) of the file (54) being just turned over, the packing or unpacking process of the brittle sheets (12) is readily performed. Therefore, in comparison with the brittle sheet (12) that is individually put into a bag, the use of the files is easier in handling of the brittle sheet (12). In addition, coming in contact with the filing pads (56), each brittle sheet (12) is protected.

FIGS. 11 to 21 show the second package of this invention.

Figure 11:
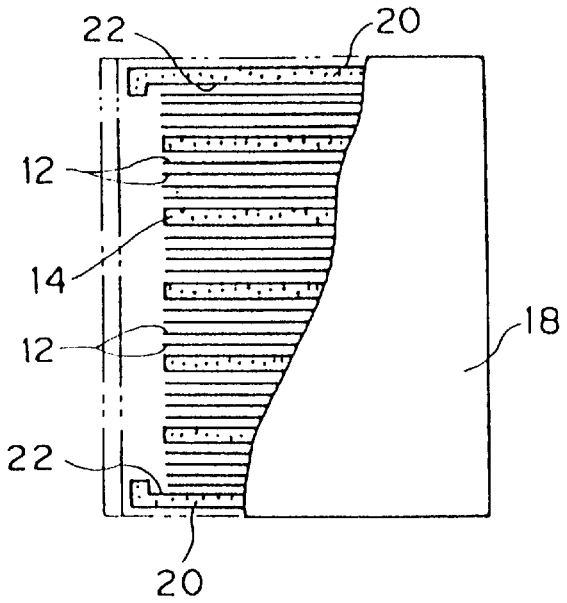
FIG. 11 is a side view of package demonstrating the embodiment of this invention.

FIG. 11 shows the package constituting the embodiment of the second package of this invention.

The package (10) comprises the brittle sheets (12) of plane rectangular shape. Numbers of brittle sheets (12), usually 10 sheets to 10000 sheets, are overlapped and placed orthogonally to the face.

The intermediate cushioning materials (14) are placed at regular intervals in the middle of the laminated rows of the brittle sheets (12). The intermediate cushioning materials (14) are made of synthetic resin sheets and possess the same outer shape as that of the brittle sheets (12).

At both ends of the lamination layers of the brittle sheets (12), the end cushioning materials (20) (20) are placed. The end cushioning material (20) is made of the synthetic resin foam. Its plane constitutes a coast rectangular shape larger than that of the brittle sheets (12), and the inner face in contact with the brittle sheet (12) holds the hollow part (22) whose size is almost same as that of the brittle sheet (12).

As shown in FIG. 11, the pillar-like laminated body comprising the brittle sheets (12) and the intermediate cushioning materials (14) that are placed between them at regular intervals could be protected by the side cushioning materials (18) placed at the side faces (its periphery).

In FIG. 11, the end cushioning materials (20) (20) are covered in the side cushioning materials (18); however, such embodiment is not limited. These positioning configuration will be described later.

The package (10) of rectangular pillar as is constituted above may be transported or stored as it is. It may be further placed into another packing bag or packing container for transportation.

Figure 12:
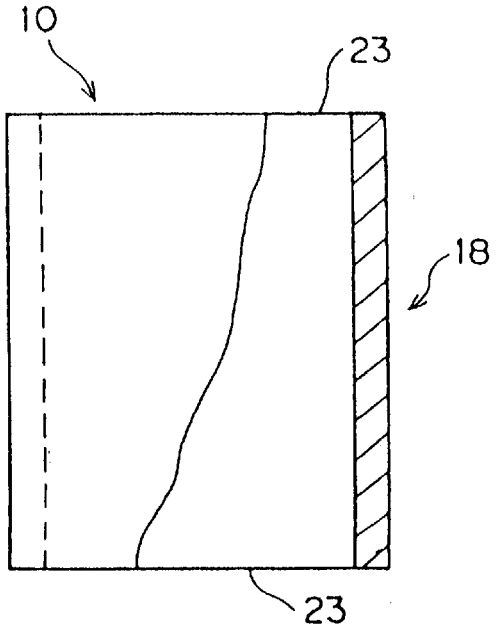
FIG. 12 is a side view showing the shape of side cushioning material.
Figure 13:
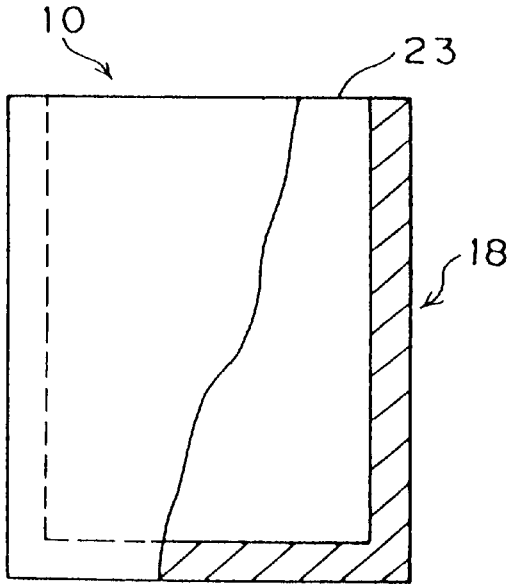
FIG. 13 is a side view showing the shape of side cushioning material.
Figure 14:
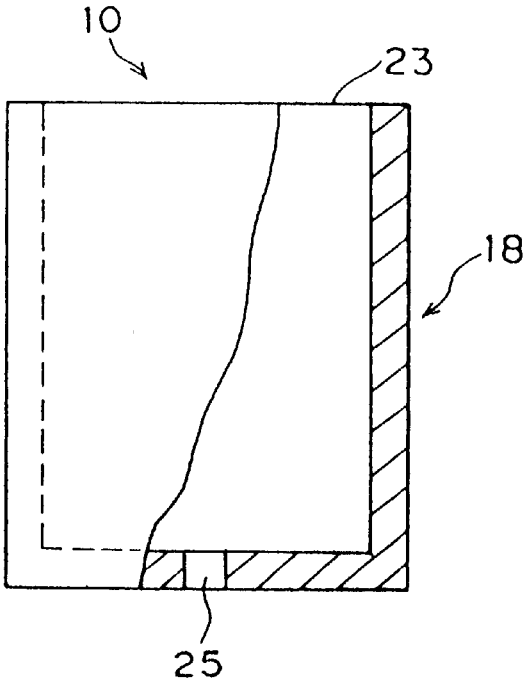
FIG. 14 is a side view showing the shape of side cushioning material.

FIGS. 12 to 14 show the various shapes of the side cushioning materials (18). In FIG. 12, the side cushioning material (18) has open surfaces (23) at the both ends and constitutes a cylindrical shape or square pillar shape. In FIG. 13, one end of the side cushioning material (18) is an open surface (23) but the other end is completely sealed. Its shape is a cup type or measure type. The side cushioning material (18) in FIG. 14 is similar to the one in FIG. 13, but there is an opening (hole 25) in the sealed surface. It constitutes a shape of cup with hole or of measure with hole.

FIGS. 15 to 18 show various examples, other than FIG. 11, demonstrating the positioning configuration of the side cushioning material (18) and the end cushioning material (20) in the package (10). In these figures, the laminated body (11) consisting of the brittle sheets (12) and the intermediate cushioning materials (14), applied if necessary, in the package (10) is illustrated with a double-dotted line.

Figure 15:
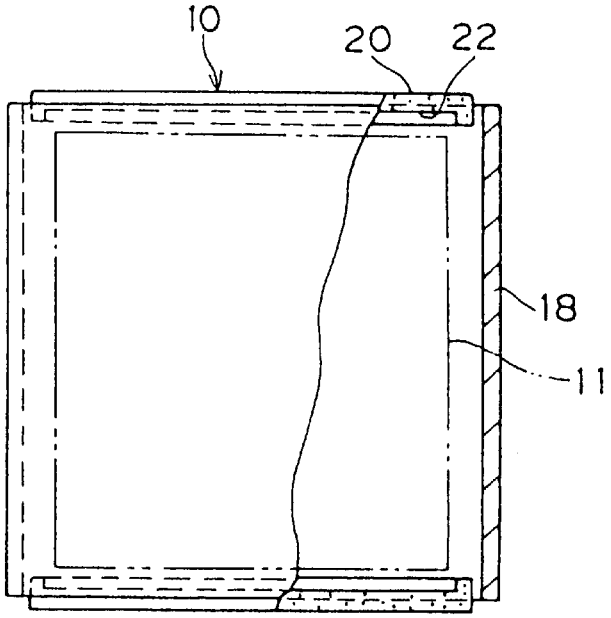
FIG. 15 is a side view showing the positioning configuration of side cushioning material and end cushioning material.

In the package (10) in FIG. 15, the end cushioning materials (20) (20) are placed at the both ends of the laminated body of brittle sheets (11), and the side cushioning material (18) that is a little larger than the outer shape of the end cushioning material (20) is placed at the side (periphery) of the end cushioning material (20).

Figure 16:
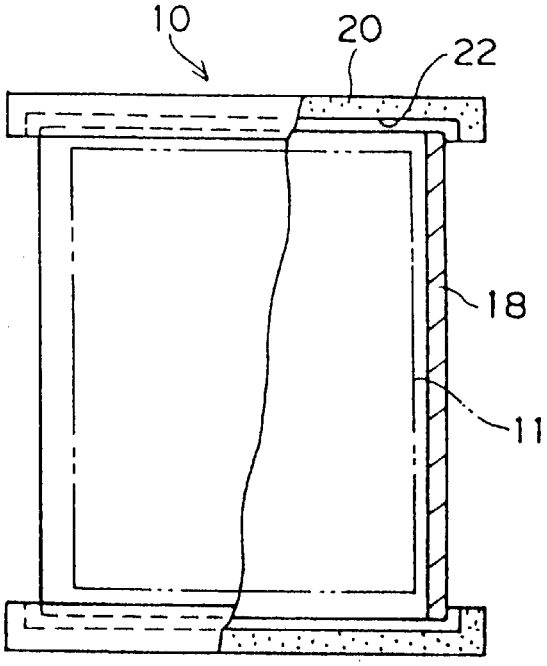
FIG. 16 is a side view showing the positioning configuration of side cushioning material and end cushioning material.

In the package (10) in FIG. 16, the side cushioning material (18) is placed at the side (periphery) of the laminated body of brittle sheets (11), and the end cushioning materials (20) (20), each of which is equipped with the hollow part (22), are placed at the both ends of the side cushioning material (18), so that the side cushioning material (18) correspondingly comes in contact with the said hollow part (22) in the end cushioning material (20).

Figure 17:
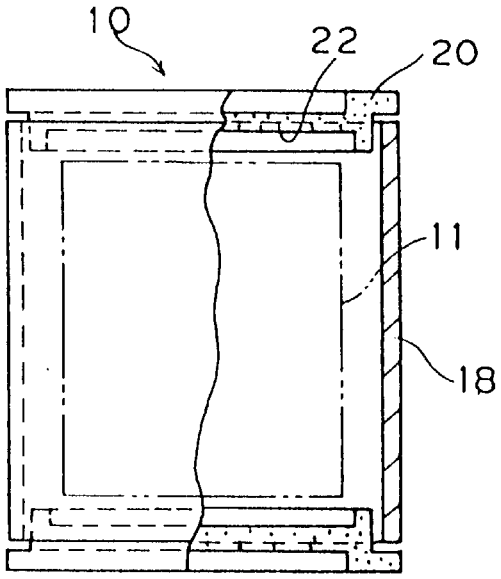
FIG. 17 is a side view showing the positioning configuration of side cushioning material and end cushioning material.

In the package (10) in FIG. 17, the end cushioning materials (20) (20), each of which is equipped with protruding parts and whose outer shapes are almost same as those of the brittle sheets (12), are placed at the both ends of the laminated body of brittle sheets (11), and the side cushioning material (18) whose size is a little larger than the said protruding part in the end cushioning material (20) and almost same as the outer shape of the end cushioning material (20) is placed at the side (periphery) of the said protruding part in the end cushioning material (20).

Figure 18:
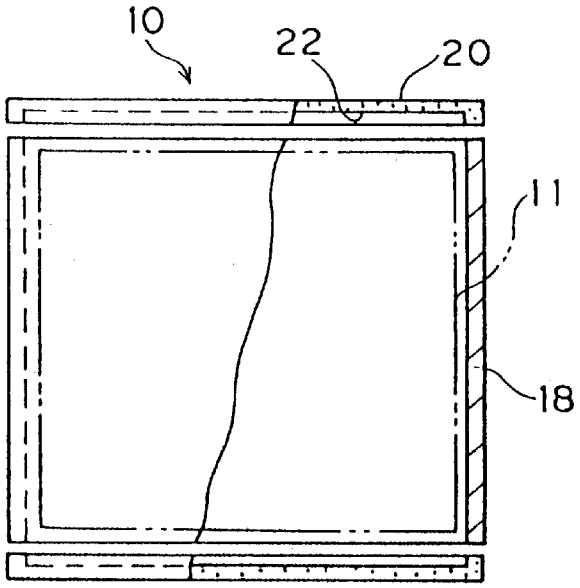
FIG. 18 is a side view showing the positioning configuration of side cushioning material and end cushioning material.

In the package (10) in FIG. 18, the side cushioning material (18) is placed at the side (periphery) of the laminated body of brittle sheets (11), and the end cushioning materials (20) (20) whose outer shapes are almost same as that of the side cushioning material (18) are placed at both ends of the side cushioning material (18).

Figure 19:
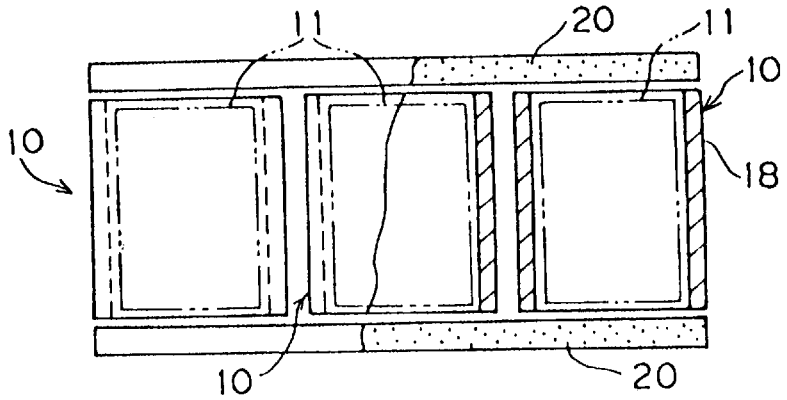
FIG. 19 is a sectional view showing the packing configuration of package.

Several packages (10) (three packages) are placed in the package configuration shown in FIG. 19; each of which is constituted in a manner that the side cushioning material (18) is placed at the side of the laminated body of brittle sheets (11). The end cushioning materials (20) (20) with such a large area as to be able to protect these packages in one lot are placed at both ends of the packages (10).

Figure 20:
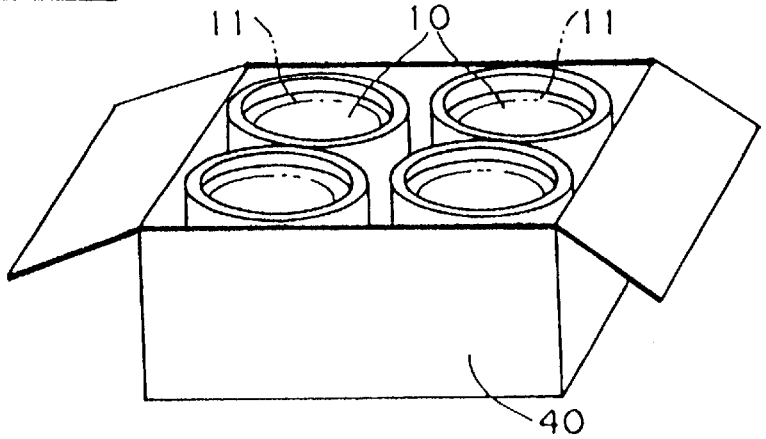
FIG. 20 is a perspective view of transporting container.

The transportation container (40) shown in FIG. 20 is able to house several packages (10) each of which contains the laminated body (11). The transportation container (40) is made of plastic such as polypropylene, metal such as duralumin, or corrugated fiberboard, and comprises a bottom face, four side faces, and an upper face that is attached to a top end of one of the sides and that can be opened and closed flexibly. When the package (10) is placed into the transportation container (40), the brittle sheets (12) (not illustrated in the figure) inside the package (10) are effectively protected against outer force. In addition, the brittle sheets (12) inside the package (10) are free from dust or foreign substance. In the packing configuration shown in the figure, the transportation container (40) contains four packages in a manner that the package (10) is arranged in two rows and in two columns.

Figure 21:
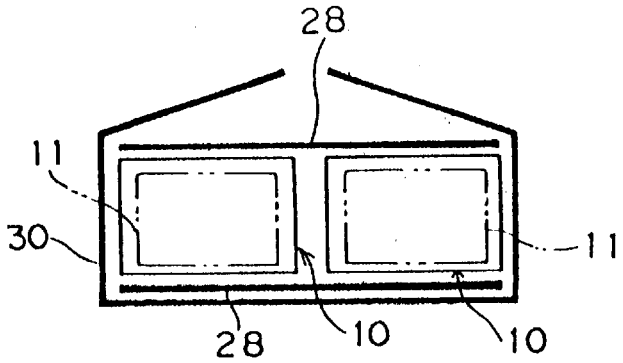
FIG. 21 is a sectional view of packing box.

The packing box (30) shown in FIG. 21 contains two packages (10) each of which contains the laminated body (11), and is equipped with pads (28) at the top and the bottom of the box. The packing box (30) is made from corrugated fiberboard and its top and bottom covers are folded down to form the box. In the figure, the bottom cover is folded down but the top cover is not completely folded down.

[Effect and Advantage of the invention]

According to the first package and packing method of this invention, the brittle sheets, which was difficult to be sufficiently protected from shock, could be definitely free from any crack or deformation during transportation of storage when they are placed in a state of lamination and covered with specific cushioning materials at the both ends. In addition, the structure of the packing materials is not complicated, the packing and unpacking processes of the brittle sheets are easy to be handled, and the time and cost required for packaging or transportation and storage could be considerably reduced.

According to the second package and packing method of this invention, the brittle sheets, which was difficult to be sufficiently protected from shock, could be definitely free from any crack or deformation during transportation of storage when they are placed in a state of lamination and covered with specific cushioning materials at the sides. In addition, the structure of the packing materials is not complicated, the packing and unpacking processes of the brittle sheets are easy to be handled, and the time and cost required for packaging or transportation and storage could be considerably reduced.

DETAILED DESCRIPTION OF THE PREFERRED EMBODIMENTS

The packages of this invention are manufactured and the result of the evaluation on their performance is explained.

TABLE 1

| Brittle sheet | A1 | B1 | C1 | D1 |
|---|---|---|---|---|
| Composition | 3% yttria stabilized zirconia | 8% yttria stabilized zirconia | alumina + magune-sium oxide | nickel oxide + 8% yttria stabilized zirconia |
| Particle size distribution of slurry | | | | |
| Mean particle diameter (μm) | 0.35 | 0.12 | 0.65 | 0.95 |
| 90 volume % diameter (μm) | 0.85 | 0.88 | 1.47 | 1.83 |
| shape | 150 mm ϕ × 50 μm thick | 100 mm ϕ × 300 μm thick | 200 mm square × 100 μm thick | 120 mm/ 10 mm ϕ × 400 μm thick |
| Three-point bending strength | | | | |
| Fracture load (N) | 0.41 | 5.2 | 0.64 | 4.4 |
| Three-point bending strength (N/mm2) | 980 | 340 | 390 | 200 |
| Weibull modulus | 12.2 | 10.3 | 13.1 | 10.1 |
| Surfaace roughness | | | | |
| Ry maximun(μm) | 1.1 | 2.6 | 4.5 | 8.9 |
| minimum(μm) | 0.5 | 1.1 | 0.6 | 1.7 |
| Ra maximun(μm) | 0.08 | 0.16 | 0.5 | 0.65 |
| minimum(μm) | 0.04 | 0.07 | 0.09 | 0.13 |
| Maximum waviness height (μm) | 30 | 120 | 50 | 100 |
| Ratio per thickness of sheet (%) | 60 | 40 | 50 | 25 |
| Coefficient of static friction | 0.8 | 0.6 | 0.9 | 1.9 |

TABLE 2

| Brittle sheet | A2 | A3 | B2 | B3 | B4 | C2 |
|---|---|---|---|---|---|---|
| Composition | 3% yttria stabilized zirconia | 3% yttria stabilized zirconia | 8% yttria stabilized zirconia | 8% yttria stabilized zirconia | 8% yttria stabilized zirconia | alumina |
| Particle size distribution of slurry | | | | | | |
| Mean particle diameter (μm) | 0.71 | 0.84 | 0.12 | 0.12 | 0.12 | 1.65 |
| 90 volume % diameter (μm) | 1.96 | 2.15 | 0.88 | 0.88 | 0.88 | 5.47 |
| shape | 150 mm ϕ × 50 μm thick | 150 mm ϕ × 50 μm thick | 100 mm ϕ × 70 μm thick | 100 mm ϕ × 50 μm thick | 100 mm ϕ × 300 μm thick | 200 mm square × 100 μm thick |
| Three-point bending strength | | | | | | |
| Fracture load (N) | 0.44 | 0.18 | 0.26 | 0.17 | 5.69 | 0.44 |
| Three-point bending strength (N/mm2) | 1030 | 590 | 340 | 290 | 370 | 290 |
| Weibull modulus | 7.8 | 8.3 | 8.3 | 7.4 | 12.6 | 6.5 |
| Surfaace roughness | | | | | | |
| Ry maximun(μm) | 4.7 | 2.8 | 2.6 | 2.8 | 0.2 | 6.9 |
| minimum(μm) | 1.3 | 0.7 | 0.9 | 1.0 | 0.08 | 1.4 |
| Ra maximun(μm) | 1.1 | 0.42 | 0.17 | 0.16 | 0.02 | 0.52 |
| minimum(μm) | 0.1 | 0.08 | 0.05 | 0.05 | 0.01 | 0.1 |

TABLE 2-continued

| Brittle sheet | A2 | A3 | B2 | B3 | B4 | C2 |
|---|---|---|---|---|---|---|
| Maximum waviness height (μm) | 60 | 20 | 50 | 50 | 30 | 90 |
| Ratio per thickness of sheet (%) | 120 | 40 | 70 | 100 | 10 | 90 |
| Coefficient of static friction | 3.4 | 2.2 | 1.9 | 2.2 | 0.3 | 3.2 |

TABLE 3

| | Side cushioning material | Thickness (mm) | Proof compression load in vertical direction(N) | Proof compression load in lateral direction(N) |
|---|---|---|---|---|
| A | Cylindrically rolled paper | 5 | 12260 | 290 |
| B | Cylindrically rolled paper (baseplate attached) | 3 | 8530 | 780 |
| C | Square pillar shaped Poly vinyl cloride | 6 | 20590 | 490 |
| D | Cylindrically rolled paper | 1 | 1770 | 50 |
| E | Square pillar shaped Poly vinyl cloride | 2 | 2450 | 80 |

TABLE 4

| | End cushioning material | Thickness (mm) | Elasticity (mm) |
|---|---|---|---|
| a | Polyethylene foam | 6 | 5 |
| b | Semi-rigid polyurethane foam | 3 | 8 |
| c | Corrugated fiberboard (double) | 8 | 120 |
| d | Polyethylene foam | 1 | 1 |
| e | Plywood | 3 | 150 or more |

TABLE 5

| | Intermediate cushioning material | Thickness (mm) | Elasticity (mm) |
|---|---|---|---|
| i | Polyethylene foam | 0.5 | 1 |
| ii | Corrugated fiberboard (double) | 4 | 85 |

WORKING EXAMPLES I

[Manufacture of the brittle sheets]

With respect to 100 parts by weight of 3 mole % yttria stabilized zirconia powder on the market (product name "HSY-3.0" made by Daiichi Kigenso Kagaku Kogyo Co., Ltd.), 15 parts by weight of the binder consisting of metacrylic copolymer (molecular weight: 30000, glass transition temperature: −8° C.), 2 parts by weight of dibutylphthalate as plasticizer, and 50 parts by weight of the mixed solvent of toluene/isopropanol (weight ratio=3/2) as disperse medium were put into a nylon pot in which 5 mm ϕ of a zirconia ball was charged, and this was mixed at approximately 60 rpm, which is 70% of the critical speed, for 40 hours to prepare slurry.

Part of the above-prepared slurry was taken and diluted with the mixed solvent of toluene/isopropanol (weight ratio=3/2), and then the particle size distribution of solid component in the slurry was measured with the particle size distribution apparatus made by Shimadzu Corporation "SALD-1100." As a result, a mean particle diameter (50 volume % diameter) was found to be 0.35 μm, a 90 volume % diameter was to be 0.85 μm and a critical particle diameter (100 volume % diameter) was to be 1.95 μm.

The slurry was so concentrated for degassing that the viscosity of the slurry was adjusted at 3 Pa·s (23° C.). After passed through a filter of 200 mesh, it was coated on a polyethylene terephthalate (PET) film according to the doctor blade method, and finally a green sheet is obtained.

This green sheet was cut in a circular shape. For defatting, the top and the bottom surfaces of the circular sheet was interposed between the 99.5 weight % alumina porous plate (porosity: 30%) of 10 μm in maximum waviness height. The sheet was burned at 1480° C. for 3 hours, and then a 3 mole % yttria stabilized zirconia sheet of 150 mm round and 50 μm in thickness (A1) was obtained.

The sheet obtained was cut into rectangular pieces of 5 mm×50 mm with the ceramic cutter equipped with diamond blade (made by Marto Co., Ltd.). With these rectangular pieces, serving as test pieces, the three-point bending strength was measured, respectively (fracture load, three-point bending strength, and Weibull modulus). The results were shown in Table 1.

Furthermore, in the sheet, the bright side that was in contact with PET film (PET surface) and the other air-revealed face (Air surface) were divided into squares of 15 mm, respectively. Concerning approximately 200 pieces from two surfaces, the values of surface roughness (the maximum height Ry, the arithmetic mean roughness Ra) were measured with the surface roughness measuring device "Surfcom1400A12." As an analysis parameter, the standards of JIS B-0601 revised in 1994 was applied. The result was shown in Table 1.

For the maximum waviness height, a slit of which gap is adjustable was mounted on a surface plate. The zirconia sheet obtained was skidded on the plate and passed through under the slit. When the sheet could not be passed through under the slit, the magnitude of thickness of the sheet was subtracted from the magnitude of gap of the slit. The obtained value was set to be the maximum waviness height. The result was shown in Table 1.

The coefficient of static friction was obtained according to the following procedures. On a 50×50 mm square felt of 2 mm in thickness, a silicon rubber plate of the same size was adhered and united. This united body was placed on the above-stated 3 mole % yttria stabilized zirconia sheet of 150 mm round and 50 μm in thickness in a manner that the felt came in contact with the sheet. The body was pulled at a speed of 100 mm/mn with a load cell. Then the maximum load, initial point to start, was read and the measurement was carried out. The result was shown in Table 1.

On the manufacturing method above stated, the same raw material s put into a nylon pot in which 15 mm ϕ of a nylon resin ball was charged, and this was mixed at approximately 40 rpm, which is 50% of the critic al speed, for 40 hours to prepare slurry.

Part of this slurry was taken and, according to the same procedures above stated, the particle size distribution of solid component was measured.

As a result, a mean particle diameter (50 volume % diameter) was found to be 0.71 μm, a 90 volume % diameter was to be 1.96 μm and a critical particle diameter (100 volume % diameter) was to be 3.68 μm.

With this slurry, a green sheet was obtained according to the same procedures above. The sheet, which was not interposed between the alumina porous plate, was defatted and burned, and a 3 mole % yttria stabilized zirconia sheet of 150 mm round and 50 μm in thickness was obtained. Then, the surface of the Air surface side was scratched with No. 100 sandpaper (made of Sankyo Rikagaku Co., Ltd. : DCC-100CC-CW) and finally a zirconia sheet (A2) was obtained.

In addition, in t he manufacturing condition for zirconia sheet (A1), only the ball mill condition was changed to "at 60 rpm and for 5 hours," and as a result, zirconia sheet (A3) was obtained.

And, part of the slurry thus obtained under this ball mill condition was taken and, according to the same procedures above stated, the particle size distribution of solid component was measured. As a result, a mean particle diameter (50 volume % diameter) was found to be 0.84 μm, a 90 volume % diameter was to be 2.15 μm and a critical particle diameter (100 volume % diameter) was to be 5.33 μm.

With respect to the zirconia sheet (A2) and the zirconia sheet (A3), the three-point bending strength (fracture load, three-point bending strength, and Weibull modulus), the surface roughness (maximum height (Ry), arithmetic mean roughness (Ra)), the maximum waviness height, and the coefficient of static friction were respectively measured in accordance with the above procedures. The results were shown in Table 2.

[Manufacture of package]

For the brittle sheets (12), 3000 sheets of the zirconia sheets (A1) of 150 mm round and 50 μm in thickness, that are made of the above-obtained 3 mole % yttria stabilized zirconia, are used.

For the end cushioning plate (26), the polyethylene foam (a) specified in Table 4 is used, which is 6 mm in thickness, 151 mm of square, and 0.068 in density (made of Hayashi Felt Co., Ltd., product name: Sanberuka L1400). The elasticity of the end cushioning plate (26) was 5.0 mm.

The 3000 sheets of zirconia sheets (A1) were placed together in layer and the end cushioning plates (26) were put at the both ends of the laminated body.

Then, with the polypropylene tape (made by Sekisui Chemical Co., Ltd., product name: P.P. Band, 15 mm in width), the laminated body of cylindrical shape consisting of the zirconia sheets (A1) that is interposed between the end cushioning plates (26) was fixed in the following steps. Pass the tape round the body on a pair of facing sides and then pass it round the body on the other pair of facing sides in a manner that the tape is crossed on both ends. Fix the end of the tape, and then the laminated body consisting of the zirconia sheets (A1) and the end cushioning plates (26) are united and firmly bound with the tape. The surface pressure applied on the zirconia sheets (A1) and the end cushioning plates (26) at that time was 4900 Pa.

The package (10) thus obtained is called working example I-1.

The package (10) was manufactured according to the same procedures as those in the working example I-1, except that the number of zirconia sheets (A1) was changed from 3000 to 10000, thus obtained package (10) is called working example I-2.

The package (10) was manufactured according to the same procedures as those in the working example I-1, except that the end cushioning plates (26) were not used. Thus obtained package (10) is called comparison example I-1.

The package (10) was manufactured according to the same procedures as those in the working example I-1, except that the end cushioning plates (26) were made with the polyethylene foam (elasticity: 1 mm) (d) of 1 mm in thickness which is specified in Table 4. Thus obtained package (10) is called comparison example I-2.

The package (10) was manufactured according to the same procedures as those in the working example I-1, except that the end cushioning plates (26) were made with the plywood (elasticity: greater than 150 mm, unmeasurable because it was cracked during the test) (e) of 3 mm in thickness which is specified in Table 4. Thus obtained package (10) is called comparison example I-3.

In addition, the package (10) was manufactured according to the same procedures as those in the working example I-1, except that 3000 sheets of the zirconia sheets (A2) were used. Thus obtained package (10) is called comparison example IV-4.

[Manufacture of transportation body]

The package (10) obtained in the above processes, the working example I-1 and the comparison examples I-1 to 4, were placed into a bag made from an anti-electrostatic material, and the opening of the bag was sealed. As an anti-electrostatic material, the film formed with the polyolefine resin, in which an anti-electrostatic agent was added and mixed, was used.

The tray type cushion holding materials (44) (46), as shown in FIG. 4, were prepared for the top and the bottom. Four sets of the bags each of which contained the package (10) were placed into the transportation container (40) made of corrugated fiberboard (double). In addition, the transportation container (40) was filled up with the cushion material made from polyethylene (made by Asahi Chemical Industry Co., Ltd., product name: Aspacsarasara).

Therefore, 12000 zirconia sheets are packed in the transportation container (40), and the weight of the transportation container (40) totally amounts to 68 kg.

Furthermore, nine sets of the bags each of which contained the package (10), which was obtained in the previous process of the working example I-2, were placed in three rows and in three columns in the transportation container (40) made of corrugated fiberboard (double). In the container, the tray type cushion holding materials (44) (44) and two cushion holding materials (46), which were put between them, were also placed. The transportation container (40) was filled up with the cushion material made from polyethylene (made by Asahi Chemical Industry Co., Ltd., product name: Aspacsarasara).

Therefore, 90000 zirconia sheets are packed in the transportation container (40), and the weight of the transportation container (40) totally amounts to 620 kg.

[Performance evaluation test]

In compliance with the JIS Z-0202, a drop test (cantilever drop test) was carried out, in which the transportation container (40) housing the 12000 zirconia sheets that was obtained in the previous process was dropped from a table of 15 cm down to the floor. Then the damaged state of the zirconia sheets inside was evaluated. For the structure of the floor, urethane coating was applied on the concrete surface.

Furthermore, according to the JIS Z-0205, an incline impact test was conducted, in which the transportation container (40) was mounted on the loading space of a glider on rail and, with a slope of 10 degrees, the glider was bumped against the shock plate. Then the damaged state of the zirconia sheets inside was evaluated.

The results of the tests conducted on the packages (10), which was obtained in the working example I-1 and the comparison examples I-1 to 4, are shown in Table 6 below.

Sixteen transportation containers (40), each of which contains 90000 zirconia sheets that were obtained in the previous process, were stacked flat and then fixed on an ordinary pallet for transportation. This pallet was carried on a 2-ton truck and the truck made a round drive between Himeji and Tokyo. Then the damaged state of the zirconia sheets inside the transportation containers was evaluated. As a result, crack were observed in 14 sheets and the percent defective was turned out to be 0.02%.

In accordance with the same procedures as those stated above, a zirconia sheet of 70 μm in thickness (B2) and a zirconia sheet of 50 μm in thickness (B3) were manufactured.

Furthermore, the surface of the zirconia sheet (B1) was polished with No. 1500 sandpaper (made of Sankyo Rikagaku Co., Ltd.: DCC-1500CC-CW) an d a zirconia sheet (B4) was obtained.

In accordance with the same procedures as those in the working examples I, the properties of the sheets, zirconia sheets (B2) to (B4), were measured. The results were shown in Table 2.

TABLE 6

| | Blittle sheet | Maximun height Ry (μm) | Mean roughness Ra (μm) | Three-point fracture load (g) | Elasticity of end cushioning material (mm) | Damage ratio of ceramic plate (%) Drop test | Incline impact test |
|---|---|---|---|---|---|---|---|
| Working example I-1 | A1 | 0.5~1.1 | 0.04~0.08 | 42 | 5 | 2 | 1 |
| Comparison example I-1 | A1 | 0.5~1.1 | 0.04~0.08 | 42 | — | 11 | 19 |
| Comparison example I-2 | A1 | 0.5~1.1 | 0.04~0.08 | 42 | 1 | 16 | 6 |
| Comparison example I-3 | A1 | 0.5~1.1 | 0.04~0.08 | 42 | >150 | 18 | 6 |
| Comparison example I-4 | A2 | 1.3~4.7 | 0.1~1.1 | 45 | 5 | 13 | 4 |

As a result of the above tests, concerning the working example I-1, because of the use of the end cushioning plate holding an adequate elasticity, the failure rate of brittle sheets could be largely reduced, as compared with that of the comparison example I-1 with no end cushioning plate. On the other hand, concerning the comparison example I-2 and the comparison example I-3, their failure rates were turned out to be greater than that of the comparison example I-1 with no end cushioning plate. This finding proved that the use of end cushioning plates that possess reasonable elasticity is necessary. Concerning the comparison example I-4, since the surface roughness of the brittle sheets was large, as compared with the working example I-1 in which the brittle sheets possess an adequate surface roughness, its failure rate was observed to be considerably high.

In addition, as for practical transportation by truck, the failure rate was turned out to be not more than 0.1% and proved satisfactory.

WORKING EXAMPLES II

[Manufacture of the brittle sheets]

Slurry was prepared in accordance with the same procedures as those in the working examples I, except that the mixed powder of 100 parts by weight of 8 mole % yttria stabilized zirconia powder on the market (product name "HSY-8.0" made by Daiichi Kigenso Kagaku Kogyo Co., Ltd.) and 0.5 parts by weight of high purity alumina powder (made by Taimei Chemicals Co., Ltd., product name "TMDAR") was used.

Part of the above-prepared slurry was taken, and in accordance with the same procedures as those in the working examples I, the particle size distribution of solid component in the slurry was measured. As a result, a mean particle diameter (50 volume % diameter) was found to be 0.12 μm, a 90 volume % diameter was to be 0.88 μm and a critical particle diameter (100 volume % diameter) was to be 2.1 μm.

With the use of this slurry, and in accordance with the same procedures as those in the working examples I, a 8 mole % yttria stabilized zirconia sheet of 100 mm in diameter and 300 μm in thickness (B1) was obtained.

In accordance with the same procedures as those in the working examples I, the properties of the sheet were measured. The results were shown in Table 1.

[Manufacture of package]

For the brittle sheets (12), 1000 sheets of the disk-like zirconia sheets (B1) of 100 mm in diameter and 300 μm in thickness, that are made of the above-obtained 8 mole % yttria stabilized zirconia, are used.

In bunches of ten sheets, the zirconia sheets (B1) were placed inside the file (54) as shown in FIG. 9. The file (54) was made of paper and its flats surface is 110 mm square.

The end cushioning material (20), as shown in FIG. 2, was used. The material was the same as that of the end cushioning plate (26), as previously described in the working examples I. The hollow part (22) consisted of a circle, and inner diameter of 102 mmø, and was 5 mm in thickness. The total thickness of the end cushioning material (20) was 10 mm With the test piece collected from the inner bottom part of the hollow part (22), measurement was carried out and the elasticity was turned out to be 4.5 mm.

The 1000 zirconia sheets (B1), which were divided and placed inside the files (54), and the end cushioning materials (20)(20), which were placed on the both ends, were bound up by means of the said polypropylene tape. As previously described, the tape was so crossed on both ends that the zirconia sheets (B1) and the end cushioning materials (20) (20) were tightly fixed. Thus the package (10) was completed. The surface pressure applied on the zirconia sheets (B1) at that time was 19600 Pa.

The package (10) thus obtained consisted of 1000 zirconia sheets (B1) and reached the weight of approximately 14 kg. This is called working example II-1.

The package (10) was manufactured according to the same procedures as those in the working example II-1, except that the end cushioning materials (20) were not used and then only the zirconia sheets (B1) that were placed inside the files were laminated. Thus obtained package (10) is called comparison example II-1.

The package (10) was manufactured according to the same procedures as those in the working example II-1, except that the zirconia sheets (B2) of 70 μm were used. Thus obtained package (10) is called working example II-2.

The package (10) was manufactured according to the same procedures as those in the working example II-1, except that the zirconia sheets (B3) of 50 μm were used. Thus obtained package (10) is called working example II-3.

[Manufacture of transportation body]

In accordance with the same procedures as those in the working examples I, the packages (10) obtained in the above processes, the working examples II-1 to 3 and the comparison examples II-1 and 2, were placed into a bag made from an anti-electrostatic material. And again, in accordance with the working examples I, with the use of the tray type cushion holding materials (44)(46), the packages (10) were placed in 3 rows and in 3 columns in the transportation container (40), which consisted of the carrying case made of duralumin. The transportation container (40) was filled up with the cushion material made from polyethylene, as described previously.

[Performance evaluation test]

The same tests as described in the working examples I were carried out. The results are shown in Table 7 below.

TABLE 7

| | Blittle sheet | Maximun height Ry (μm) | Mean roughness Ra (μm) | Three-point fracture load (g) | Elasticity of end cushioning material (mm) | Damage ratio of ceramic plate (%) Drop test | Incline impact test |
|---|---|---|---|---|---|---|---|
| Working example II-1 | B1 | 1.1~2.6 | 0.07~0.16 | 530 | having | 5 | 4 |
| Working example II-2 | B2 | 0.9~2.6 | 0.05~0.17 | 27 | having | 33 | 5 |
| Working example II-3 | B3 | 1.0~2.8 | 0.05~0.16 | 17 | having | 37 | 16 |
| Comparison example II-1 | B1 | 1.1~2.6 | 0.07~0.16 | 530 | none | 19 | 13 |

As a result of the above tests, in comparison between the working examples I-1 to 3 and the comparison examples II-1, it was confirmed that the application of the end cushioning plate (20) is useful. In addition, in comparison between the working examples II-1 and the working examples II-2and 3, it was found that the protection function of packages varied depending on the characteristics of the brittle sheets (three-point bending fracture load).

WORKING EXAMPLES III

[Manufacture of the brittle sheets]

Slurry was prepared in accordance with the same procedures as those in the working examples I other than the powder. In this case, 0.5 weight % of magnesia oxide was added to the alumina powder on the market (made by Showa Denko K. K., product name "AL-160SG") and this mixed powder was used.

Part of the above-prepared slurry was taken, and in accordance with the same procedures as those in the working examples I, the particle size distribution of solid component in the slurry was measured. As a result, a mean particle diameter was found to be 0.65 μm, a 90 volume % diameter was to be 1.47 μm and a critical particle diameter was to be 4.3 μm.

With the use of this slurry, and in accordance with the same procedures as those in the working examples I, a green sheet was manufactured.

This green sheet was cut in a square shape. For defatting, the top and the bottom of the sheet was interposed between the alumina spacer (porosity: 15%) of 10 μm in maximum waviness height. After that, the sheet was burned at 1575° C. for 3 hours, and then an alumina sheet of 200 mm square and 100 μm in thickness (C1) was obtained.

In accordance with the same procedures as those in the working examples I, the properties of the sheet were measured. The results were shown in Table 1.

In addition, in accordance with the same procedures, except that only the alumina powder on the market (made by Showa Denko K. K., product name "AL-15-2") was used as raw material powder, that 11 parts by weight of the binder described above was added, that the ball mill time was for 20 hours, and that burning was performed at 1650° C. for 5 hours, an alumina sheet (C2) of 200 mm square and 100 μm in thickness (C1) was obtained.

In accordance with the same procedures as those in the working examples I, the properties of the sheet were measured. The results were shown in Table 2.

[Manufacture of package]

For the brittle sheets (12), 5000 alumina sheets (C1) (of 200 mm square and 100 μm in thickness were used; as stated above, 500 ppm of magnesia was added into the alumina.

For the packing box (30), a corrugated fiberboard box of a rectangular parallelepiped was used, as shown in FIG. 3. The box is 21 cm long, 55 cm wide and 21 cm high, and its top surface serves as a cover which is flexibly opened and closed. Inside the packing box (30), the end cushioning plates (26) are adhered at the both ends of longitudinal direction. Each plate is 21 cm long, 21 cm wide and 3 mm thick, and is made of semi-rigid polyurethane foam (made of Hayashi Felt Co., Ltd., product name: COLOR FOAM EMT, density: 0.060) (b) specified in Table 4. The elasticity of the end cushioning plates (26) was 8 mm. In the rest of the sides, the bottom and the back of the cover, inner sheets are adhered, each of which is 21 cm long and 55 cm wide and made of ester-based polyurethane foam (made of Hayashi Felt Co., Ltd., product name: Morutopuren SC, density: 0.031).

The alumina sheets (C1) are overlapped face to face and put into the packing box (30). The intermediate cushioning materials (14) are placed every 500 sheets of the alumina sheets (C1). The material for the intermediate cushioning material (14) was the same as that for the end cushioning material (26). After 5000 alumina sheets (C1) were contained, the cover of the packing box (30) was put down and the box was tightly taped. The surface pressure applied on the alumina sheets (C1) at that time was 2940 Pa.

The package (10) thus obtained is called working example III-1.

The package (10) was manufactured according to the same procedures as those in the working example III-1, except that the number of the sheets consisting of the maximum waviness height of 100 μm (100% of the thickness) and the static friction coefficient of 2.1 was limited to 100 in the 5000 sheets. The package (10) thus obtained is called comparison example III-1.

In addition, the package (10) was manufactured according to the same procedures as those in the working example III-1, except that the alumina sheets (C2) were used as alumina sheets. The package (10) thus obtained is called comparison example III-2.

[Manufacture of transportation body]

In accordance with the same procedures as those in the working examples I, the package (10) obtained in the working example III-1 and the comparison examples III-1 and 2 were placed into a bag. The bag used is made of polyethylene. After the packages were contained, the bag was bound and fastened with the polypropylene tape, as described previously.

Six bags, each of which contains the package (10), were placed in the transportation container (40), an ordinary wooden box for transportation. The space between the transportation container (40) and the bags was filled up with the cushion material made of polyethylene, as described previously.

[Performance evaluation test]

The same tests as described in the working examples I were carried out. The results are shown in Table 8 below.

TABLE 8

| | Blittle sheet | maximum waviness height (%) | Coefficient of static friction | Damage ratio of cermanic plate (%) Drop test | Incline impact test |
|---|---|---|---|---|---|
| Working example III-1 | C1 | 50 | 0.9 | 6 | 3 |
| Comparison example III-1 | C1* | 100 | 2.1 | 24 | 7 |
| Comparison example III-2 | C2 | 90 | 3.2 | 16 | 17 |

*Comparison example III-1: the number of the sheets consisting of the maximum waviness height of 100 μm (100%) and static friction coefficient of 2.1 was limited to 100 in the 5000 sheets.

As a result of the above tests, it was proved that the protection function of the packages varied depending on the maximum waviness height and the coefficient of static friction.

WORKING EXAMPLES IV

Slurry was prepare in accordance with the same procedures as those in the working examples I other than the powder for raw material and the quantity of binder. In this example, 60 weight % of nickel oxide powder (made by Kishida Chemical Co., Ltd.) and 40 weight % of 8 mole % yttria stabilized zirconia powder (made by Daiichi Kigenso Kagaku Kogyo Co., Ltd., product name "HSY-8.0") were mixed, and the quantity of the binder made of metacrylic copolymer (molecular weight: 30000, glass transition temperature: −8° C.) was changed to 13 parts by weight.

Part of the above-prepared slurry was taken, and in accordance with the same procedures as those in the working examples I, the particle size distribution of solid component in the slurry was measured. As a result, a mean particle diameter was found to be 0.95 μm, a 90 volume % diameter was to be 1.83 μm and a critical particle diameter was 7.2 μm.

With the use of this slurry, and in accordance with the same procedures as those in the working examples I, a green sheet was manufactured.

This green sheet was cut in a doughnut shape, for defatting, the top and the bottom of the sheet was interposed between the alumina spacer (porosity: 15%) of 10 μm in maximum waviness height. After that, the sheet was burned at 1350° C. for 3 hours, and then a nickel oxide/zirconia sheet of 120 mmø in outer diameter, 10 mmø in inner diameter and 400 μm in thickness (D1) was obtained.

In accordance with the same procedures as those in the working examples I, the properties of the nickel oxide/zirconia sheet (D1) were measured. The results were shown in Table 1.

WORKING EXAMPLES V

[Manufacture of package]

Three thousand sheets of the 3 mole % yttria stabilized zirconia sheets (A1), which was obtained in the working examples I and is specified in the Table 1, were placed in a state of lamination on the end cushioning materials (a) of 152 mmø (the polyethylene foam made by Hayashi Felt Co., Ltd., product name: Sanberuka L1400), which is specified in Table 4. With the side cushioning materials (A) of 152 mmø (The cylindrically rolled paper made by Kobe Danboru Co., Ltd.), which is specified in Table 3 and whose shape is as shown in FIG. 12, the laminated body of the sheets was so covered as to be illustrated in FIG. 15. After the side of the body was properly covered, the edge part of the side cushioning material was put under the end cushioning material. Next, after the end cushioning material (a) was placed on the top of the laminated body, its edge was put under the side cushioning material. Thus the package A1-(1) was formed.

In accordance with the same procedures as those stated above, except that the side cushioning material (D), which was specified in Table 3, was used as the side cushioning material, the package A1-(2) was formed.

In the above procedures, instead of the side cushioning materials (A), the end cushioning materials were placed. Then the entire body was put into a polyethylene bag of 0.04 mm thick, and the package A1-(3) was formed.

In the above procedures, the intermediate cushioning materials (i), (the polyethylene foam made by Kawakami Industries Co., Ltd., product name: AIR FOAM AF-05), which are specified in Table 5, were placed every 150 sheets of the zirconia sheets (A1). Thus the package A1-(4) was formed.

In the above procedures, every bunch of 150 sheets of zirconia sheets (A1) was put into a polyethylene bag of 0.04 mm thick. The number of the bags amounted to 20. Thus the package A1-(5) was formed.

In the above procedures, every bunch of 150 sheets of the zirconia sheets (A1) was put into a polyethylene bag of 0.04 mm thick. The number of the bags amounted to 20. And the intermediate cushioning materials (i), which are specified in Table 5, were filled in the space between the bags and the package A1-(6) was formed.

Three thousand sheets of the zirconia sheets (A1) were placed in a state of lamination on the end cushioning materials (b) of 152 mmø (the semi-rigid polyurethane foam made by Hayashi Felt Co., Ltd., product name: COLOR FOAM EMT), which is specified in Table 4. With the side cushioning materials (B) of 152 mmø, which is specified in Table 3 and whose shape is as shown in FIG. 14, the laminated body of the sheets was so covered as not to be slide. After the side of the body was properly covered, the edge part of the side cushioning material was put under the said end cushioning material (b). Thus the package A1-(7) was formed. In this example, the laminated body is so held between the base plate of the side cushioning material (B) and the end cushioning material (b) as to be immovable.

In addition, every bunch of 150 sheets of the zirconia sheets (A1) was put into a polyethylene bag of 0.04 mm thick. 20 such bags were piled in a state of lamination. Then two sets of the laminated bodies were placed on the end cushioning material (c) of 152×304 mm square. The 6000 sheets were covered with the side cushioning material (A), which was specified in Table 3, and the end cushioning material (c) was placed on them as illustrated in FIG. 19. Thus, the package A1-(8) was formed. In this example, the end cushioning material serves as a pad.

In addition, according to the same procedures in the above package A1-(8), except that the side cushioning material (A) was not used, the package A1-(9) was formed.

The 3000 sheets of the zirconia sheets (A1) were placed together in layer and the end cushioning materials (a), which are specified in Table 4 and a square of 152 mm, were put at the both ends of the laminated body. With the polypropylene tape (made by Sekisui Chemical Co., Ltd., product name: P.P. Band, 15 mm in width), the laminated body of a cylindrical shape consisting of the zirconia sheets (A1) that is interposed between the end cushioning plates (a) was fixed in the following steps. Pass the tape round the body on a pair of facing sides and then pass it round the body on the other pair of facing sides in a manner that the tape is crossed on both ends. Fix the end of the tape, and then the laminated body consisting of the zirconia sheets (A1) and the end cushioning materials (a) is united and firmly bound with the tape. Then the side cushioning materials (C) of 154 mm in inner diameter were inserted and the package A1-(10) was formed.

According to the same procedures as those in the package A1-(10), except that the side cushioning material (E), which is specified in Table 3, was used for the side cushioning material and the end cushioning materials (d), which is specified in Table 4, was used for the end cushioning material, the package A1-(11) was formed.

According to the same procedures as those in the package A1-(10), except that the side cushioning material (E), which is specified in Table 3, was used for the side cushioning material and the end cushioning materials (e), which is specified in Table 4, was used for the end cushioning material, the package A1-(12) was formed.

With the same procedures as stated above, and with respect to the brittle sheets obtained in the working examples I to IV, each package was manufactured according to the combination of the end cushioning materials, the side cushioning materials and the intermediate cushioning materials specified in Table 9 and 10.

However, the surface polished zirconia sheets (B4) were subject to slippage when they were being piled in layer, they were impossible to be vertically placed. Therefore, every bunch of 200 sheets were attached with cellophane tape to be placed in a state of lamination.

WORKING EXAMPLES VI

[Manufacture of packed body]

The package A1-(1) to (12), which were manufactured in the working examples V, were placed in a transportation container, as shown in FIG. 20. The container is made of corrugated fiberboard and a square of 176 mm×352 mm in inner diameter and 150 mm in height (made by Kobe Danboru Co., Ltd., double). One pair from the package A1-(8) and the package A1-(9) and two pairs from other packages were placed. Then the space between the corrugated fiberboard and the side cushioning materials or the end cushion materials was filled up with the cushion material made from polyethylene (made by Kawakami Industries Co., Ltd., product name: AIR FOAM AF-05), and the packed body was formed. The weight of each packed body consisting of 6000 sheets amounts to approximately 34 kg.

The packages A1-(1) to (3), (5), (10) and (11) were placed into a duralumin case for transportation container. Similar to the above, the space between the case and the side cushioning materials or the end cushion materials was filled up with the cushion material made from polyethylene, and the packed body was formed. The weight of each packed body consisting of 18000 sheets amounts to approximately 100 kg.

For the other packages, packed body was formed as above stated. Each packed body is described in Tables 11 and 12.

[Test example 1]

With each packed body, which was obtained in the working examples IV and is specified in Tables 11 and 12, and in compliance with the JIS Z-0202, a drop test (cantilever drop test) was carried out, in which each packed body was dropped from a table of 15 cm down to the floor. Then the damaged state of the brittle sheets inside was visually observed and evaluated. For the structure of the floor, urethane coating was applied to the concrete surface.

Furthermore, according to the JIS Z-0205, an incline impact test was conducted, in which each packed body was mounted on the loading space of a glider on rail and, with a slope of 10 degrees, the glider was bumped against the shock plate. Then the damaged state of the brittle sheets inside was visually observed and evaluated.

In addition, according to the JIS Z-0232, a vibration test was carried out, in which each packed body was mounted on a sinusoidal vibration testing machine (maximum acceleration: 0.12 m/sec$^2$, vibration frequency 5 to 100 Hz). Then the damaged state of the brittle sheets inside was visually observed and evaluated.

As for the packed body B4-(1) 4, sheet cracks also occurred when cellophane tape was removed after the test.

Next, concerning the packed bodies A1-(1) 6, A1-(2) 6, A1-(3) 6, A1-(5) 6, A1-(10) 6, A1-(11)6, B1-(1) 9, B2-(1) 9, C1-(1) 2, C1-(2) 2 and C2-(1) 2, 6 packed bodies were stacked flat and fixed on an ordinary pallet for transportation. As for the packed bodies A1-(8) 1 and A1-(9) 1, 18 packed bodies were stacked in two layers and fixed on an ordinary pallet for transportation. This pallet was carried on a truck and a transportation test was conducted between Himeji and Tokyo. Then the damaged state of the brittle sheets inside each packed body was evaluated.

The results of the above tests were shown in Table 11 and 12.

TABLE 9

| Package | Brittle sheet | Sheets per unit | Unit | Laminated sheets | Group of laminated sheets | Total of sheets | Side cushioning material | End cushioning material | Intermediate cushioning material | Bag |
|---|---|---|---|---|---|---|---|---|---|---|
| A1-(1) | A1 | 3000 | 1 | 3000 | 1 | 3000 | A | a | none | none |
| A1-(2) | A1 | 3000 | 1 | 3000 | 1 | 3000 | D | a | none | none |
| A1-(3) | A1 | 3000 | 1 | 3000 | 1 | 3000 | none | a | none | having |
| A1-(4) | A1 | 150 | 20 | 3000 | 1 | 3000 | A | a | i | none |
| A1-(5) | A1 | 150 | 20 | 3000 | 1 | 3000 | A | a | none | having |
| A1-(6) | A1 | 150 | 20 | 3000 | 1 | 3000 | A | a | i | having |
| A1-(7) | A1 | 3000 | 1 | 3000 | 1 | 3000 | B | b | none | none |
| A1-(8) | A1 | 150 | 20 | 3000 | 2 | 6000 | A | c | none | having |
| A1-(9) | A1 | 150 | 20 | 3000 | 2 | 6000 | none | c | none | having |
| A1-(10) | A1 | 3000 | 1 | 3000 | 1 | 3000 | C | a | none | none |

TABLE 9-continued

| Package | Brittle sheet | Sheets per unit | Unit | Laminated sheets | Group of laminated sheets | Total of sheets | Side cushioning material | End cushioning material | Intermediate cushioning material | Bag |
|---|---|---|---|---|---|---|---|---|---|---|
| A1-(11) | A1 | 3000 | 1 | 3000 | 1 | 3000 | E | d | none | none |
| A1-(12) | A1 | 3000 | 1 | 3000 | 1 | 3000 | E | e | none | none |

TABLE 10

| Package | Brittle sheet | Sheets per unit | Unit | Laminated sheets | Group of laminated sheets | Total of sheets | Side cushioning material | End cushioning material | Intermediate cushioning material | Bag |
|---|---|---|---|---|---|---|---|---|---|---|
| A2-(1) | A2 | 3000 | 1 | 3000 | 1 | 3000 | A | a | none | none |
| A2-(2) | A2 | 3000 | 1 | 3000 | 1 | 3000 | D | a | none | none |
| A3-(1) | A3 | 3000 | 1 | 3000 | 1 | 3000 | A | a | none | none |
| A3-(2) | A3 | 3000 | 1 | 3000 | 1 | 3000 | none | a | none | none |
| B1-(1) | B1 | 200 | 5 | 1000 | 1 | 1000 | A | a | none | having |
| B1-(2) | B1 | 200 | 5 | 1000 | 2 | 2000 | A | a | none | having |
| B2-(1) | B2 | 200 | 5 | 1000 | 1 | 1000 | A | a | none | having |
| B3-(1) | B3 | 200 | 5 | 1000 | 1 | 1000 | A | a | none | having |
| B4-(1) | B4 | 200 | 5 | 1000 | 2 | 2000 | A | a | none | having |
| C1-(1) | C1 | 5000 | 1 | 5000 | 1 | 5000 | C | b | none | none |
| C1-(2) | C1 | 5000 | 1 | 5000 | 1 | 5000 | E | b | none | none |
| C1-(3) | C1 | 5000 | 1 | 5000 | 1 | 5000 | E | e | none | none |
| C2-(1) | C2 | 5000 | 1 | 5000 | 1 | 5000 | C | c | none | none |
| C2-(2) | C2 | 5000 | 1 | 5000 | 1 | 5000 | C | e | none | none |
| D1-(1) | D1 | 200 | 5 | 1000 | 1 | 1000 | A | a | i | none |
| D1-(2) | D1 | 200 | 5 | 1000 | 1 | 1000 | A | a | ii | none |

TABLE 11

| Packed body | Pacage | Group of package | Total of sheets | Damage ratio of ceramic plate (%) | | | |
|---|---|---|---|---|---|---|---|
| | | | | Drop test | Incline impact test | Vibration test | Transportation test |
| A1-(1) 2 | A1-(1) | 2 | 6000 | 1.7 | 0.8 | 0.08 | — |
| A1-(1) 6 | A1-(1) | 6 | 18000 | — | — | — | 0.01 |
| A1-(2) 2 | A1-(2) | 2 | 6000 | 8.8 | 9.7 | 0.07 | — |
| A1-(2) 6 | A1-(2) | 6 | 18000 | — | — | — | 2.4 |
| A1-(3) 2 | A1-(3) | 2 | 6000 | 10.9 | 15.3 | 1.1 | — |
| A1-(3) 6 | A1-(3) | 6 | 18000 | — | — | — | 5.1 |
| A1-(4) 2 | A1-(4) | 2 | 6000 | 1.5 | 1.2 | 0.06 | — |
| A1-(5) 2 | A1-(5) | 2 | 6000 | 1.1 | 0.8 | 0.08 | — |
| A1-(5) 6 | A1-(5) | 6 | 18000 | — | — | — | 0.01 |
| A1-(6) 2 | A1-(6) | 2 | 6000 | 0.9 | 0.4 | 0.07 | — |
| A1-(7) 2 | A1-(7) | 2 | 6000 | 1.8 | 1.9 | 0.05 | — |
| A1-(8) 1 | A1-(8) | 1 | 6000 | 4.9 | 3.7 | 0.1 | 0.05 |
| A1-(9) 1 | A1-(9) | 1 | 6000 | 21.7 | 14.0 | 1.3 | 4.2 |
| A1-(10) 2 | A1-(10) | 2 | 6000 | 2.0 | 1.1 | 0.1 | — |
| A1-(10) 6 | A1-(10) | 6 | 18000 | — | — | — | 0.02 |
| A1-(11) 2 | A1-(11) | 2 | 6000 | 14.3 | 17.6 | 0.1 | — |
| A1-(11) 6 | A1-(11) | 6 | 18000 | — | — | — | 3.6 |
| A1-(12) 2 | A1-(12) | 2 | 6000 | 16.5 | 9.2 | 0.1 | — |
| A2-(1) 2 | A2-(1) | 2 | 6000 | 18.2 | 15.0 | 1.2 | — |
| A2-(2) 2 | A2-(2) | 2 | 6000 | 23.1 | 20.4 | 1.5 | — |
| A3-(1) 2 | A3-(1) | 2 | 6000 | 25.8 | 18.9 | 1.9 | — |
| A3-(2) 2 | A3-(2) | 2 | 6000 | 32.4 | 27.6 | 3.4 | — |

TABLE 12

| Packed body | Pacage | Group of package | Total of sheets | Damage ratio of ceramic plate (%) | | | |
|---|---|---|---|---|---|---|---|
| | | | | Drop test | Incline impact test | Vibration test | Transportation test |
| B1-(1) 4 | B1-(1) | 4 | 4000 | 3.6 | 2.8 | 0.3 | — |
| B1-(1) 9 | B1-(1) | 9 | 9000 | — | — | — | 0.06 |
| B1-(2) 2 | B1-(2) | 2 | 4000 | 3.9 | 2.3 | 0.3 | — |
| B2-(1) 4 | B2-(1) | 4 | 4000 | 27.2 | 24.5 | 2.2 | — |
| B2-(1) 9 | B2-(1) | 9 | 9000 | — | — | — | 4.6 |
| B3-(1) 4 | B3-(1) | 4 | 4000 | 31.6 | 29.3 | 2.5 | — |
| B4-(1) 4 | B4-(1) | 4 | 4000 | 2.8 | 2.4 | 0.01 | — |
| C1-(1) 2 | C1-(1) | 2 | 10000 | 5.0 | 4.1 | 0.2 | 0.07 |
| C1-(2) 2 | C1-(2) | 2 | 10000 | 12.8 | 16.5 | 0.4 | 6.5 |

TABLE 12-continued

| Packed body | Pacage | Group of package | Total of sheets | Damage ratio of ceramic plate (%) | | | |
|---|---|---|---|---|---|---|---|
| | | | | Drop test | Incline impact test | Vibration test | Transportation test |
| C1-(3) 2 | C1-(3) | 2 | 10000 | 17.7 | 16.0 | 0.9 | — |
| C2-(1) 2 | C2-(1) | 2 | 10000 | 30.9 | 32.2 | 3.8 | 5.0 |
| C2-(2) 2 | C2-(2) | 2 | 10000 | 34.5 | 26.4 | 4.7 | — |
| D1-(1) 1 | D1-(1) | 1 | 1000 | 3.6 | 3.3 | 0.1 | — |
| D2-(2) 1 | D2-(2) | 1 | 1000 | 4.2 | 1.8 | 0.1 | — |

What is claimed is:

1. A package for brittle sheets, which comprises a stack of fuel cell brittle sheets, wherein each of the brittle sheets includes a face confronting a face of another brittle sheet, wherein the stack of brittle sheets has two ends; and a first end cushion for being placed at one end of the stack of brittle sheets and a second end cushion for being placed at the other end of the stack of brittle sheets, wherein each of the end cushions has a size equal to or greater than a size of the end of the stack of brittle sheets at which the end cushion is placed, and wherein each of the end cushions has an elasticity range from 2 to 100 mm.

2. A package for brittle sheets according to claim 1, and further comprising an elongate binder that extends from the first end cushion to the second end cushion, wherein the elongate binder draws the first and second end cushions toward each other and brings pressure to bear upon the ends of the stack of brittle sheets.

3. A package for brittle sheets according to claim 1, wherein each of the brittle sheets has a thickness, a maximum height of waviness, and a coefficient of static friction, wherein the maximum height of waviness is not more than 80% of the thickness, and wherein the coefficient of static friction is not more than 3.

4. A package for brittle sheets according to claim 1, wherein each of the brittle sheets comprises a zirconia sintered body, wherein each of the brittle sheets has first and second faces, wherein each of the first and second faces has a surface roughness, wherein the surface roughness ranges from 0.3 to 3 $\mu$m in maximum height (Ry) and from 0.03 to 0.3 $\mu$m in arithmetic mean roughness (Ra).

5. A package for brittle sheets, which comprises a stack of fuel cell brittle sheets, wherein each of the brittle sheets includes a face confronting a face of another brittle sheet, wherein the stack of brittle sheets has at least one side; and a side cushion for being placed at the side of the stack of brittle sheets, wherein the side cushion a proof compressive load in a vertical direction and in a lateral direction, wherein the proof compressive load is not less than 1960 N in the vertical direction and not less than 98 N in the lateral direction.

6. A package for brittle sheets according to claim 5, and further comprising a first end cushion for being placed at one end of the stack of brittle sheets and a second end cushion for being placed at the other end of the stack of brittle sheets, and wherein each of the end cushions has an elasticity range from 1 to 100 mm.

7. A package for brittle sheets according to claim 5, wherein each of the brittle sheets has a thickness, a maximum height of waviness, and a coefficient of static friction, wherein the maximum height of waviness is not more than 80% of the thickness, and wherein the coefficient of static friction is not more than 3.

8. A package for brittle sheets according to claim 5, wherein each of the brittle sheets has first and second faces, wherein each of the first and second faces has a surface roughness, wherein the surface roughness ranges from 0.3 to 10 $\mu$m in maximum height (Ry).

9. A package for brittle sheets according to claim 5, wherein each of the brittle sheets comprises a zirconia sintered body, wherein each of the brittle sheets has first and second faces, wherein each of the first and second faces has a surface roughness, wherein the surface roughness ranges from 0.3 to 3 $\mu$m in maximum height (Ry) and from 0.02 to 0.3 $\mu$m in arithmetic mean roughness (Ra).

10. A package for a stack of brittle sheets, wherein the stack of brittle sheets includes first and second ends, wherein the stack includes 10 to 10,000 brittle sheets, wherein the brittle sheets are placed face to face in the stack, wherein each of the brittle sheets includes a pair of faces, wherein each of the faces includes a width and a length, wherein the package comprises:

a) a first end cushion for being placed at the first end of the stack of brittle sheets, wherein the first end cushion has a width and length equal to or greater than the width and length respectively, of the faces of the sheets of the stack of brittle sheets, wherein the first end cushion has an elasticity range from 2 to 100 mm, wherein the first end cushion includes a first inner face that confronts the first end of the stack of brittle sheets, wherein the first inner face is hollowed out to receive the first end of the stack of brittle sheets therein;

b) a second end cushion for being placed at the second end of the stack of brittle sheets, wherein the second end cushion has a width and length equal to or greater than the width and length, respectively, of the faces of the sheets of the stack of brittle sheets, wherein the second end cushion has an elasticity range from 2 to 100 mm, wherein the second end cushion includes a second inner face that confronts the second end of the stack of brittle sheets, wherein the second inner face is hollowed out to receive the second end of the stack of brittle sheets therein;

c) a set of intermediate cushions placed at intervals in the stack of brittle sheets, wherein each of the intermediate cushions includes a width and length less than the width and length, respectively, of each of the first and second end cushions;

d) wherein the first end cushion includes a first periphery, wherein the first periphery includes four binder first grooves, wherein two of the binder first grooves are aligned with each other on opposite sides of the first periphery and wherein another two of the binder first grooves are aligned with each other on opposite sides of the first periphery;

e) wherein the second end cushion includes a second periphery, wherein the second periphery includes four binder second grooves, wherein two of the binder second grooves are aligned with each other on opposite sides of the second periphery and wherein another two of the binder second grooves are aligned with each other on opposite sides of the second periphery;

f) wherein each of the first binder grooves is aligned with one of the second binder grooves; and g) an elongate binder portion extending to and between said first binder grooves and said second binder grooves that are aligned with each other such that four binder portions extend to and between the first and second end cushions to draw the first and second end cushions toward each other and bring pressure to bear upon the first and second ends of the stack of brittle sheets.

11. A package for a stack of brittle sheets, wherein the stack of brittle sheets includes first and second ends, wherein the stack includes 10 to 10,000 brittle sheets, wherein the brittle sheets are placed face to face in the stack, wherein each of the brittle sheets includes a pair of faces, wherein each of the faces includes a width and a length, wherein the package comprises:

a) a first end cushion for being placed at the first end of the stack of brittle sheets, wherein the first end cushion has a width and length equal to or greater than the width and length, respectively, of the faces of the sheets of the stack of brittle sheets, wherein the first end cushion has an elasticity range from 2 to 100 mm, wherein the first end cushion includes a first inner face that confronts the first end of the stack of brittle sheets;

b) a second end cushion for being placed at the second end of the stack of brittle sheets, wherein the second end cushion has a width and length equal to or greater than the width and length, respectively, of the faces of the sheets of the stack of brittle sheets, wherein the second end cushion has an elasticity range from 2 to 100 mm, wherein the second end cushion includes a second inner face that confronts the second end of the stack of brittle sheets;

c) a box having first and second ends integral with each other and spaced from each other by a first distance;

d) wherein the first end cushion includes a first outer face and wherein the second end cushion includes a second outer face, wherein the first and second outer faces are spaced from each other by a second distance when the stack of brittle sheets is engaged between the first and second end cushions; and e) wherein the first distance is shorter than the second distance, wherein the first and second end cushions and stack of brittle sheets are placed in the box such that the first end of the box confronts the first outer face of the first end cushion and such that the second end of the box confronts the second outer face of the second end cushion, and wherein, when the first and second end cushions are so placed in the box with the stack of brittle sheets, the box is deformed such that a constant surface pressure is applied to the brittle sheets.

12. A package for a stack of brittle sheets, wherein the stack of brittle sheets includes first and second ends, wherein the stack includes 10 to 10,000 brittle sheets, wherein the brittle sheets are placed face to face in the stack, wherein each of the brittle sheets includes a pair of faces, wherein each of the faces includes a width and a length, wherein the package comprises:

a) a first end cushion for being placed at the first end of the stack of brittle sheets, wherein the first end cushion has a width and length equal to or greater than the width and length, respectively, of the faces of the sheets of the stack of brittle sheets, wherein the first end cushion has an elasticity range from 2 to 100 mm, wherein the first end cushion includes a first inner face that confronts the first end of the stack of brittle sheets;

b) a second end cushion for being placed at the second end of the stack of brittle sheets, wherein the second end cushion has a width and length equal to or greater than the width and length, respectively, of the faces of the sheets of the stack of brittle sheets, wherein the second end cushion has an elasticity range from 2 to 100 mm, wherein the second end cushion includes a second inner face that confronts the second end of the stack of brittle sheets;

c) a set of intermediate cushions placed at intervals in the stack of brittle sheets, wherein each of the intermediate cushions includes a width and length less than the width and length, respectively, of each of the first and second end cushions;

d) a box having first and second ends integral with each other and spaced from each other by a first distance;

e) wherein the first end cushion includes a first outer face and wherein the second end cushion includes a second outer face, wherein the first and second outer faces are spaced from each other by a second distance when the stack of brittle sheets is engaged between the first and second end cushions; and f) wherein the first distance is shorter than the second distance, wherein the first and second end cushions and stack of brittle sheets are placed in the box such that the first end of the box confronts the first outer face of the first end cushion and such that the second end of the box confronts the second outer face of the second end cushion, and wherein, when the first and second end cushions are so placed in the box with the stack of brittle sheets, the box is deformed such that a constant surface pressure is applied to the brittle sheets.

13. A package for a stack of brittle sheets placed in receptacles, wherein the stack of brittle sheets includes first and second ends, wherein the stack includes 10 to 10,000 brittle sheets, wherein the brittle sheets are placed face to face in the stack, wherein each of the brittle sheets includes a pair of faces, wherein each of the faces includes a width and a length, wherein the package comprises:

a) a first end cushion for being placed at the first end of the stack of brittle sheets, wherein the first end cushion has a width and length equal to or greater than the width and length, respectively, of the faces of the sheets of the stack of brittle sheets, wherein the first end cushion has an elasticity range from 2 to 100 mm, wherein the first end cushion includes a first inner face that confronts the first end of the stack of brittle sheets;

b) a second end cushion for being placed at the second end of the stack of brittle sheets, wherein the second end cushion has a width and length equal to or greater than the width and length, respectively, of the faces of the sheets of the stack of brittle sheets, wherein the second end cushion has an elasticity range from 2 to 100 mm, wherein the second end cushion includes a second inner face that confronts the second end of the stack of brittle sheets;

c) a set of receptacles for the brittle sheets, wherein each of the receptacles receives some of the brittle sheets of the stack of brittle sheets, wherein each of the receptacles includes a width greater than the width of said brittle sheet and a length less than the length of said brittle sheet such that a portion of said brittle sheet extends out of said receptacle;

d) a box having first and second ends spaced from each other by a first distance;

e) wherein the first end cushion includes a first outer face and wherein the second end cushion includes a second outer face, wherein the first and second outer faces are spaced from each other by a second distance when the stack of brittle sheets, including said receptacles with said brittle sheets received in said receptacles, is engaged between the first and second end cushions; and f) wherein the first distance is shorter than the second distance, wherein the first and second end cushions and stack of brittle sheets received in said receptacles are placed in the box such that the first end of the box confronts the first outer face of the first end cushion and such that the second end of the box confronts the second outer face of the second end cushion, and wherein, when the first and second end cushions are so placed in the box with the stack of brittle sheets in said receptacles, the box is deformed such that a constant surface pressure is applied to the brittle sheets.

14. A package for a stack of brittle sheets placed in files, wherein the stack of brittle sheets includes first and second ends, wherein the stack includes 10 to 10,000 brittle sheets, wherein the brittle sheets are placed face to face in the stack, wherein each of the brittle sheets includes a pair of faces, wherein each of the faces includes a width and a length, wherein the package comprises:

a) a first end cushion for being placed at the first end of the stack of brittle sheets wherein the first end cushion has a width and length equal to or greater than the width and length, respectively, of the faces of the sheets of the stack of brittle sheets, wherein the first end cushion has an elasticity range from 2 to 100 mm, wherein the first end cushion includes a first inner face that confronts the first end of the stack of brittle sheets;

b) a second end cushion for being placed at the second end of the stack of brittle sheets, wherein the second end cushion has a width and length equal to or greater than the width and length, respectively, of the faces of the sheets of the stack of brittle sheets, wherein the second end cushion has an elasticity range from 2 to 100 mm, wherein the second end cushion includes a second inner face that confronts the second end of the stack of brittle sheets;

c) a set of files for the brittle sheets, wherein each of the files receives some of the brittle sheets of the stack of brittle sheets, wherein each of the files includes a width greater than the width of said brittle sheet and a length greater than the length of said brittle sheet such that said brittle sheet is maintained in said file;

d) a set of file partitions in each of said files, wherein each of the brittle sheets is separated from another brittle sheet by one said file partition, wherein each of the file partitions includes a width greater than the width of said brittle sheet and a length greater than the length of said brittle sheet such that the file partitions protect the brittle sheets from each other; and e) a binder engaging and drawing together the first and second end cushions for applying pressure to and holding together the stack of brittle sheets placed in files.

* * * * *